US006547238B2

(12) United States Patent
Ardery et al.

(10) Patent No.: US 6,547,238 B2
(45) Date of Patent: Apr. 15, 2003

(54) SHEET BEAM BREAKER

(75) Inventors: Jeffrey Allen Ardery, Richmond, KY (US); Michael Kurt Gordon, Lexington, KY (US); Daniel Joseph Westhoff, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 130 days.

(21) Appl. No.: 09/822,530

(22) Filed: Mar. 30, 2001

(65) Prior Publication Data

US 2002/0171197 A1 Nov. 21, 2002

(51) Int. Cl.[7] ..... B65H 31/00; B65H 29/70; B65H 31/26

(52) U.S. Cl. ..... 271/209; 271/207; 271/220; 271/188

(58) Field of Search ..... 271/209, 207, 271/220, 188

(56) References Cited

U.S. PATENT DOCUMENTS

| | | | | | |
|---|---|---|---|---|---|
| 1,217,650 | A | | 2/1917 | Snyder | |
| 3,669,447 | A | | 6/1972 | Turner et al. | |
| 3,722,879 | A | * | 3/1973 | Johnston et al. | 271/176 |
| 3,970,299 | A | | 7/1976 | Berger, Jr. et al. | |
| 4,049,256 | A | | 9/1977 | Church et al. | |
| 4,060,237 | A | | 11/1977 | Degen et al. | |
| 4,257,587 | A | | 3/1981 | Smith | |
| 4,319,743 | A | | 3/1982 | Rood | |
| 4,379,549 | A | | 4/1983 | Mizuma | |
| 4,441,702 | A | * | 4/1984 | Nagel et al. | 271/177 |
| 4,548,399 | A | | 10/1985 | Heider et al. | |
| 4,789,150 | A | * | 12/1988 | Plain | 271/220 |
| 4,925,172 | A | | 5/1990 | Christy et al. | |
| 5,013,021 | A | | 5/1991 | Johdai et al. | |
| 5,021,837 | A | | 6/1991 | Uto et al. | |
| 5,033,731 | A | * | 7/1991 | Looney | 271/176 |
| 5,037,077 | A | | 8/1991 | Kubota et al. | |
| 5,131,644 | A | | 7/1992 | DuBois | |
| 5,201,515 | A | | 4/1993 | Funk | |
| 5,249,793 | A | * | 10/1993 | Scheufler | 271/188 |
| 5,288,062 | A | | 2/1994 | Rizzolo et al. | |
| 5,435,535 | A | | 7/1995 | Suzuki et al. | |
| 5,473,420 | A | | 12/1995 | Rizzolo et al. | |
| 5,791,644 | A | | 8/1998 | Regimbal et al. | |
| 5,963,754 | A | * | 10/1999 | Itoh et al. | 271/258.01 |
| 6,283,470 | B1 | * | 9/2001 | Hirai | 271/163 |

* cited by examiner

*Primary Examiner*—Donald P. Walsh
*Assistant Examiner*—Jonathan R. Miller
(74) *Attorney, Agent, or Firm*—John A. Brady

(57) ABSTRACT

A pivotally mounted bail actuator is pivotally moved from its home position to an elevated position by the leading edge of a sheet of paper exiting from sheet path exit rollers of a printer. The pivotally mounted bail actuator has a wire bail extending for more than half of the sheet width. When the sheet exits from the sheet path exit rollers, both the pivotally mounted bail actuator and the sheet simultaneously fall by gravity, and the wire bail contacts the sheet to remove any longitudinal beam and to create a lateral beam extending the width of the sheet. A rear portion of the sheet falls onto an upper support surface with most of the sheet falling onto a lower support surface. If the sheet does not have a longitudinal beam, a lateral beam is created by the height difference of the two support surfaces on which the sheet is supported. The sheet is aligned on the upper support surface.

6 Claims, 30 Drawing Sheets

SHEET BEAM BREAKER

RELATED APPLICATIONS

U.S. patent application, Ser. No. 09/774,852, filed Jan. 31, 2001, of Michael Kurt Gordon et al for "Finisher With Sheet Placement Control." U.S. patent application Ser. No. 09/793,360, filed Jan. 31, 2001, of Jeffery Allen Ardery et al for "Finisher With Frictional Sheet Mover." U.S. patent application of Daniel Mlejnek et al for "Finisher With Single Roller For Frictionally Moving Each Sheet," Ser. No. 09/822,982, filed on even date herewith. U.S. patent application of Thomas C. Wade for "Output Tray Having An Increased Capacity For Stapled Sheets," Ser. No. 09/822,614, now abandoned. filed on even date herewith.

FIELD OF THE INVENTION

This invention relates to a sheet beam breaker for breaking a longitudinal beam if it is created in a sheet being fed from sheet paper exit rollers after the sheet exits from the exit rollers and falls by gravity onto a support surface and, more particularly, to a sheet beam breaker that breaks a longitudinal beam created in a sheet being fed from sheet path exit rollers in which each sheet exits from the exit rollers and falls by gravity onto a support surface and creates a lateral beam in the sheet in the direction of alignment after removing the longitudinal beam.

BACKGROUND OF THE INVENTION

When sheets are fed from sheet path exit rollers for disposition in a stack on lower support surfaces to which each sheet falls by gravity, the sheet is not constrained when it falls onto the support surfaces. Accordingly, the sheet is free to take whatever form or shape is induced in the sheet by the sheet's internal stresses.

It is well known that internal stresses are induced in a sheet during the fusing process in a laser printer. These internal stresses cause the sheet to curl. The shape of the curl that is of interest in this invention is curl that is parallel with the length of the sheet and is referred to as L curl. The L curl significantly increases the beam strength in a sheet in the longitudinal direction; therefore, the sheet can be referred to as having a longitudinal beam.

In a finishing device, it is desirable to have sheets with consistent shape and form during the alignment of sheets at a predetermined location for consistent sheet to sheet registration. It also is desirable to have increased beam strength in the alignment direction to decrease the possibility of buckling of the sheet between aligning device and the alignment reference barrier. The desired increase in beam strength can be obtained by inducing in the sheet a form that curls the sheet such that the curl is parallel with the width of the sheet and is referred to as a W curl. Sheets with the W curl can be referred to as having a lateral beam.

To achieve a small compact design for the finishing device, the sheet that has exited the exit rollers and falls is supported on two support surfaces. The first support surface supports the rear portion of the sheet and is the area where the alignment mechanism exerts the forces on the sheet to move the sheet to the predetermined alignment location.

The second surface supports the front portion of the sheet. This second support surface also serves as the output bin for sheets that have been finished in the finisher.

Between these two support surfaces, there is a portion which is lower than the two support surfaces for the sheet.

This lower portion is for the trailing edge of the sheets to fall into after they are fed into the output bin so that the next sheet's leading edge will be fed over the trailing edge of the sheets in the output bin. This configuration produces two support surfaces with a significant gap between them such that sheets may droop in the lower center portion. This droop would form the desired W curl that would increase the beam strength in the sheet in the alignment direction.

The initial few sheets falling onto the support surfaces usually droop in the middle due to the gravitational forces exceeding the internal stresses that try to form a longitudinal beam. Therefore, a lateral beam is formed which aids in consistent alignment of the sheets at a predetermined location.

However, as the stack of sheets increases in height, the possibility exists that a sheet will not droop due to the lower sheets supporting the upper sheet thereby not allowing the gravitational forces to overcome the internal stresses in the sheet. When this occurs, a longitudinal beam may form in the sheet. This sheet with the longitudinal beam will have a different form and lower beam strength in the direction of alignment than the sheets beneath it. This condition of having a different form in the upper sheet (longitudinal beam) to the form of the initial sheets (lateral beam) will result in poor registration of the upper sheet relative to the sheets beneath it.

This lack of consistency of sheets having consistent lateral beam forms has a significant effect on alignment of a plurality of sheets in a stack. Thus, for best alignment purposes, each sheet must have substantially the same form or shape, which is a lateral beam form, when it is disposed on its support surfaces prior to being moved therealong for alignment at a predetermined location. This is particularly important when the sheets are to be stapled to each other after being aligned at the predetermined location as shown and described in the aforesaid Mlejnek et al application.

SUMMARY OF THE INVENTION

The sheet beam breaker of the present invention is capable of breaking a longitudinal beam existing in each sheet of paper or similar material falling by gravity after the sheet leaves sheet path exit rollers and is contacted by the sheet beam breaker as both the sheet beam breaker and the sheet simultaneously fall by gravity. In addition to breaking a longitudinal beam existing in any sheet that it contacts, the sheet beam breaker of the present invention also creates a beam in a lateral direction in the same sheet through exerting a lateral downward force on the sheet to create a lateral beam therein after the longitudinal beam is broken by the lateral downward force. This increased beam strength in the lateral direction aids in alignment of each sheet when the sheet is moved laterally on the support surface for alignment at the predetermined position at which the sheets are stacked and then stapled, if desired. It also insures that the sheets have substantially the same desired form or shape.

The support surfaces have at least a portion lower than the remainder of the support surfaces to provide a gap at which the droop is produced in each sheet when it is supported by the support surfaces. In the preferred embodiment, the sheet is supported on front and rear support surfaces with a lower portion between the front and rear support surfaces. Alignment of each sheet occurs on the rear portion of the support surfaces.

The sheet beam breaker is preferably a wire bail. It also preferably extends for more than half of the width of each sheet and is disposed symmetrically relative to the desired location of each sheet as the sheet falls onto the support surface.

Because the sheet beam breaker is part of a pivotally mounted bail actuator, which must be pivotally moved by the sheet during its exiting from the sheet path exit rollers, the bail actuator must not weigh more than the sheet exiting the exit rollers can support. While it would be preferred for the wire bail to extend over the entire width of the sheet, this would increase the weight of the bail actuator, and the bail actuator could not be pivoted by the sheet due to the increased weight.

An object of this invention is to provide a sheet beam breaker for breaking a longitudinal beam created in a sheet falling by gravity after being fed by sheet path exit rollers and with which the sheet beam breaker contacts as both fall by gravity.

Another object of this invention is to provide a sheet beam breaker capable of controlling the direction of a beam in a sheet falling to a support surface by gravity after its exit from sheet path exit rollers.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
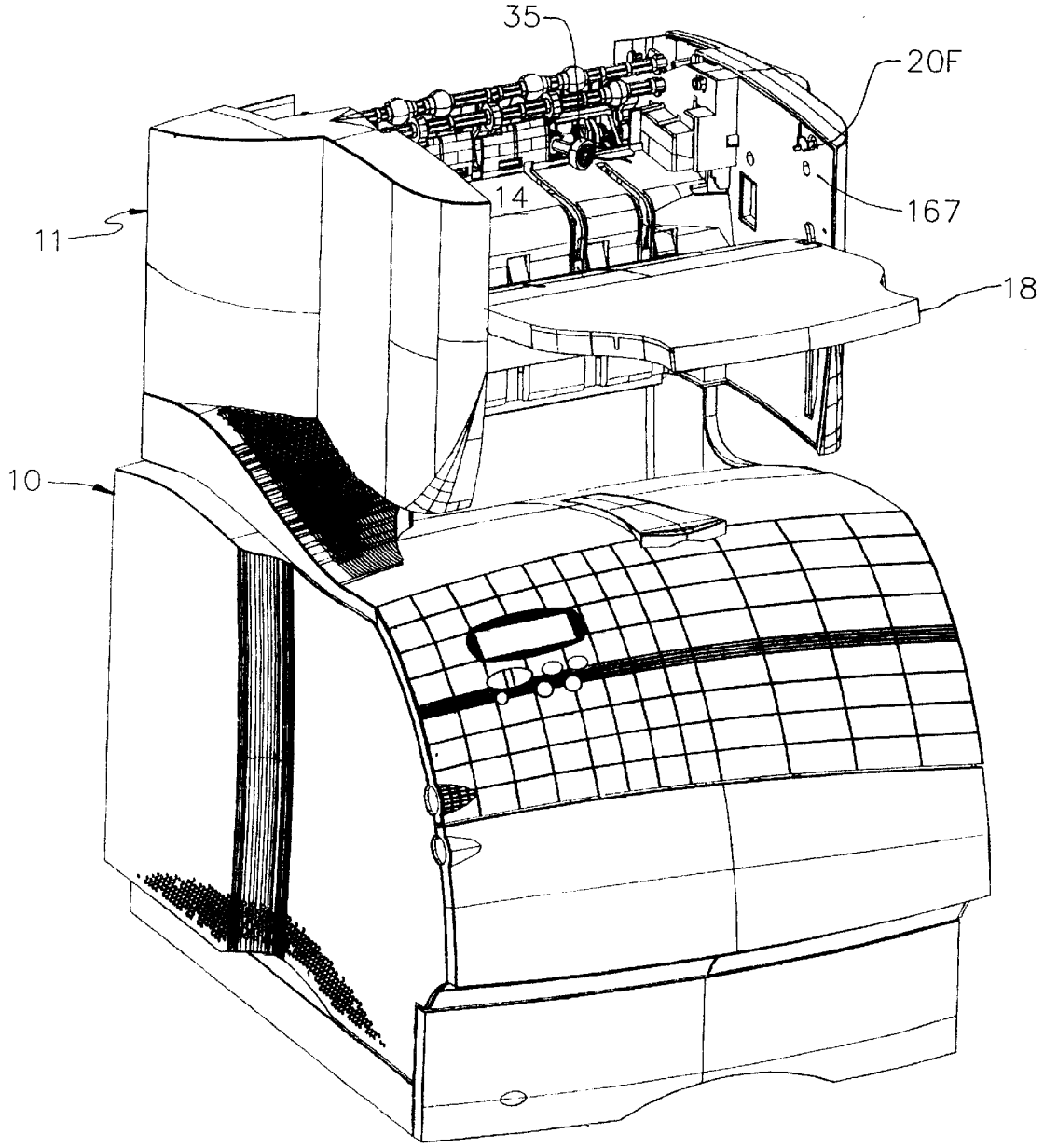
FIG. 1 is a front perspective view of a printer having a finisher disposed thereon.

Referring to the drawings and particularly FIG. 1, there is shown a printer 10 having a finisher 11, which can be detachable from the printer 10 and is supported thereby. One suitable example of the printer 10 is a laser printer sold under the trademark OPTRA by the assignee of this application or as modified in the future.

When the finisher 11 is releasably attached to the printer 10, printed sheets 12 (see FIG. 2) are fed in sequence from the rear of the printer 10 (see FIG. 1) vertically into the rear of the finisher 11. This may be in a known manner such as described in U.S. Pat. No. 5,810,353 to Baskette et al, for example.

Figure 2:
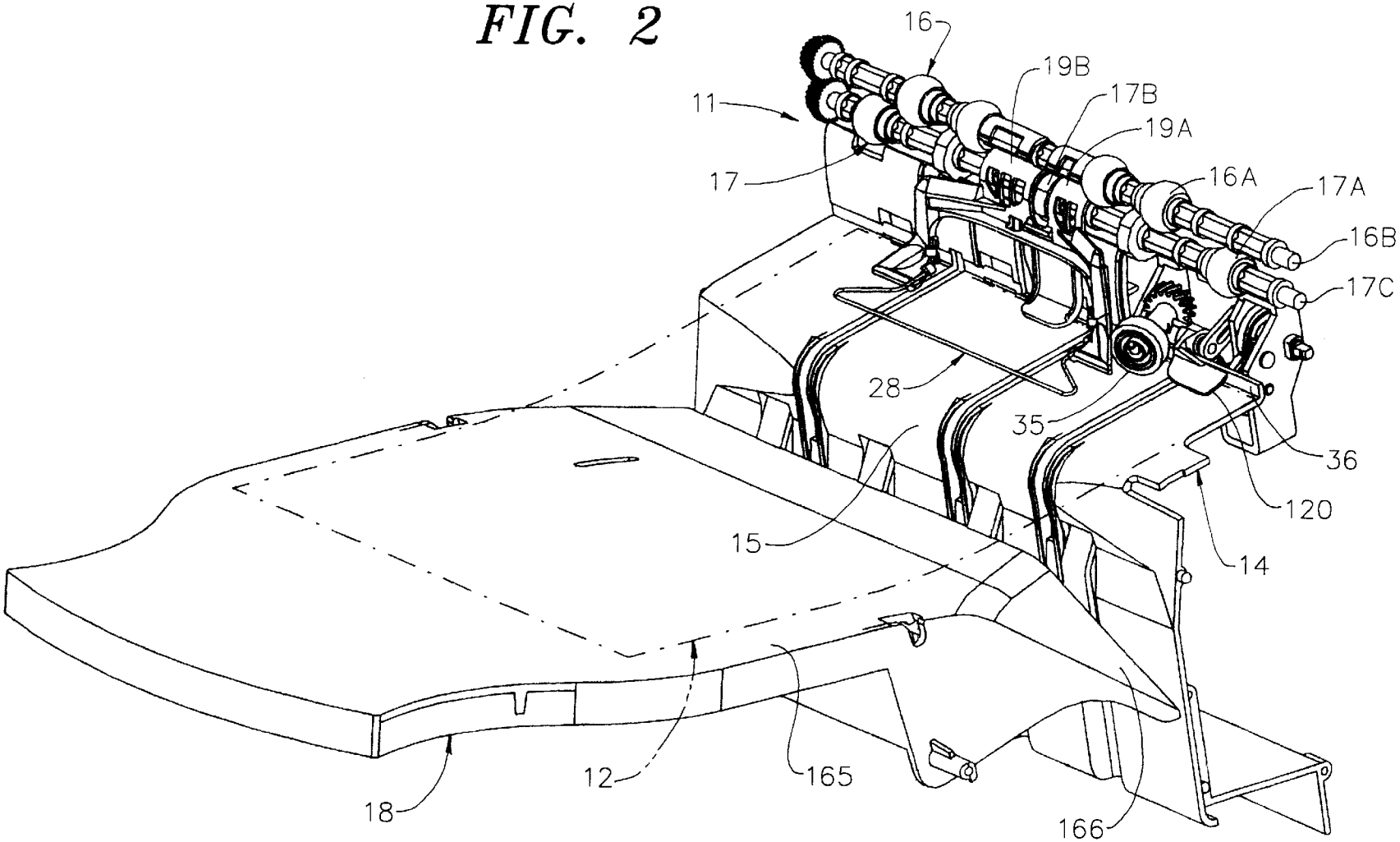
FIG. 2 is a right side perspective view of the finisher of FIG. 1 including an aligning roller, an accumulator table receiving sheets falling by gravity for support thereby during advancement by the aligning roller towards two substantially perpendicular reference barriers, and an inclined output tray to which each sheet (shown in phantom) is advanced after being aligned with the two reference barriers by the aligning roller.
Figure 3:
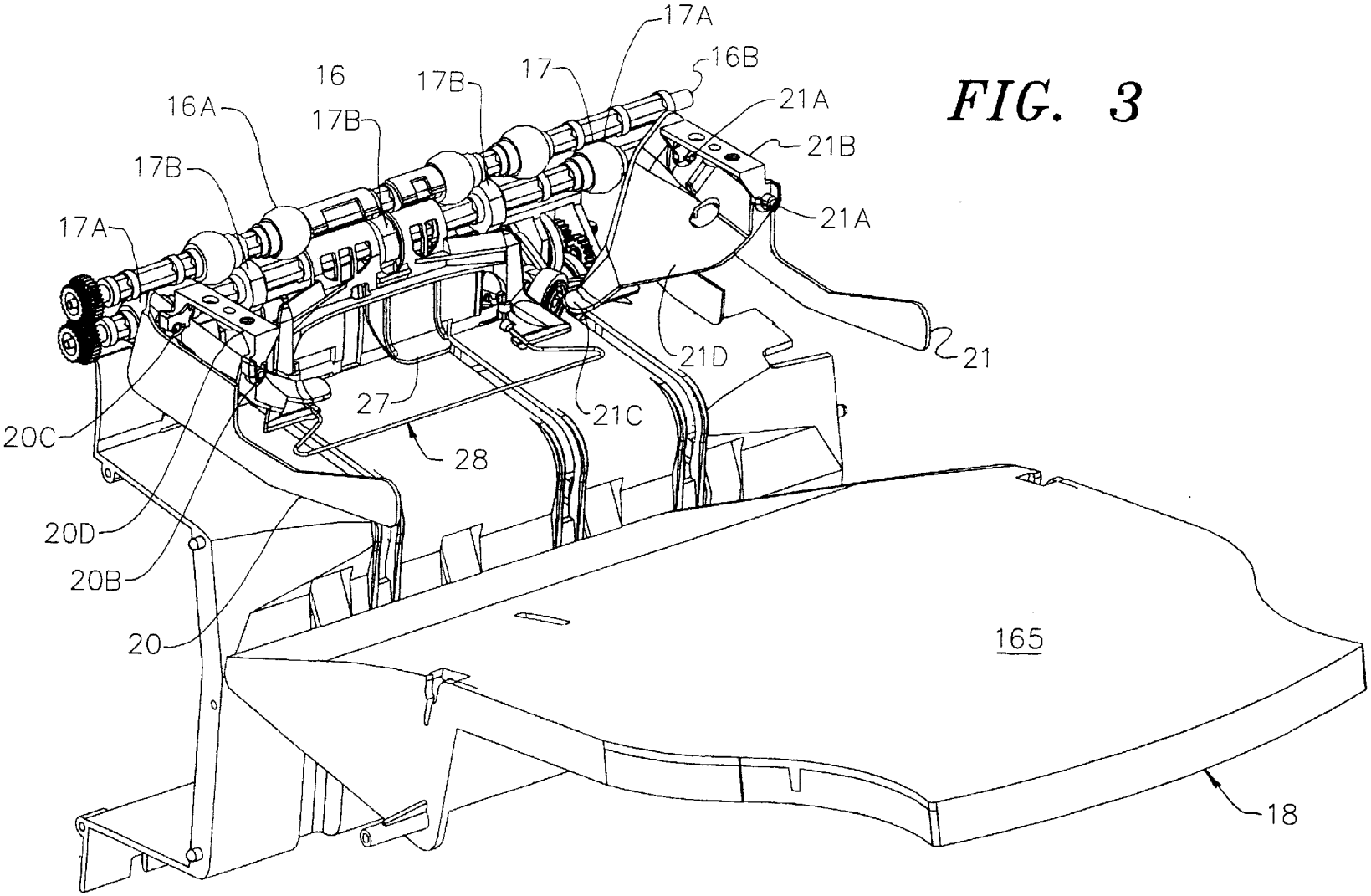
FIG. 3 is a left side perspective view of the finisher of FIG. 2 with left and right bails added thereto.

The finisher 11 includes an accumulator table 14 (see FIG. 2) having an upper support surface 15 to which each of the printed sheets 12 is fed by an upper cooperating set 16 (see FIG. 3) of four exit corrugation rollers 16A mounted on a shaft 16B and a lower cooperating set 17 of two large corrugation rollers 17A and three small corrugation rollers 17B mounted on a shaft 17C (see FIG. 2). The axial spacing of the four exit corrugation rollers 16A (see FIG. 3) on the shaft 16B relative to the two large corrugation rollers 17A and the three small corrugation rollers 17B of the set 17 is particularly shown and described in the aforesaid Ardery et al application, Ser. No. 09/793,360, which is incorporated by reference herein.

Thus, the corrugation rollers 16A and the corrugation rollers 17A and 17B cooperate to induce wave shapes across each of the printed sheets 12 (see FIG. 2) exiting therefrom but only while the printed sheets 12 are engaged by the rollers 16A, 17A, and 17B. After each of the printed sheets 12 exits the two sets 16 and 17 of the exit corrugation rollers 16A, 17A, and 17B, each of the printed sheets 12 falls onto the upper support surface 15 of the accumulator table 14 for support thereby or on top of another of the printed sheets 12 already supported by the upper support surface 15 of the accumulator table 14. The printed sheet 12 falls by gravity and the engaging force of a pivot actuator 19 (see FIG. 21) also falling by gravity.

As each of the printed sheets 12 (see FIG. 2) falls onto the upper support surface 15 of the accumulator table 14, most of each of the printed sheets 12 will be supported on an inclined output tray 18. The inclined output tray 18 is spring mounted to be continuously urged upwardly to maintain the vertical separation between the upper support surface 15 of the accumulator table 14 and the topmost sheet 12 supported on the inclined output tray 18 as the printed sheets 12 are disposed on it.

The bail actuator 19 (see FIG. 21) has a pair of arcuate extensions 19A and 19B pivotally mounted on the shaft 16B (see FIG. 22) of the upper set 16 of the exit corrugation rollers 16A. As each of the printed sheets 12 exits from between the corrugation roller sets 16 and 17, its leading edge 19C engages a back surface 19D of each of the arcuate extensions 19A and 19B (see FIG. 21) in a portion not wrapped around the shaft 16B. This exerts a force on the bail actuator 19 to cause the bail actuator 19 to move from its rest or home position of FIG. 22 to its position in FIG. 23 through the bail actuator 19 pivoting 20° about the axis of the shaft 16B.

Figure 23:
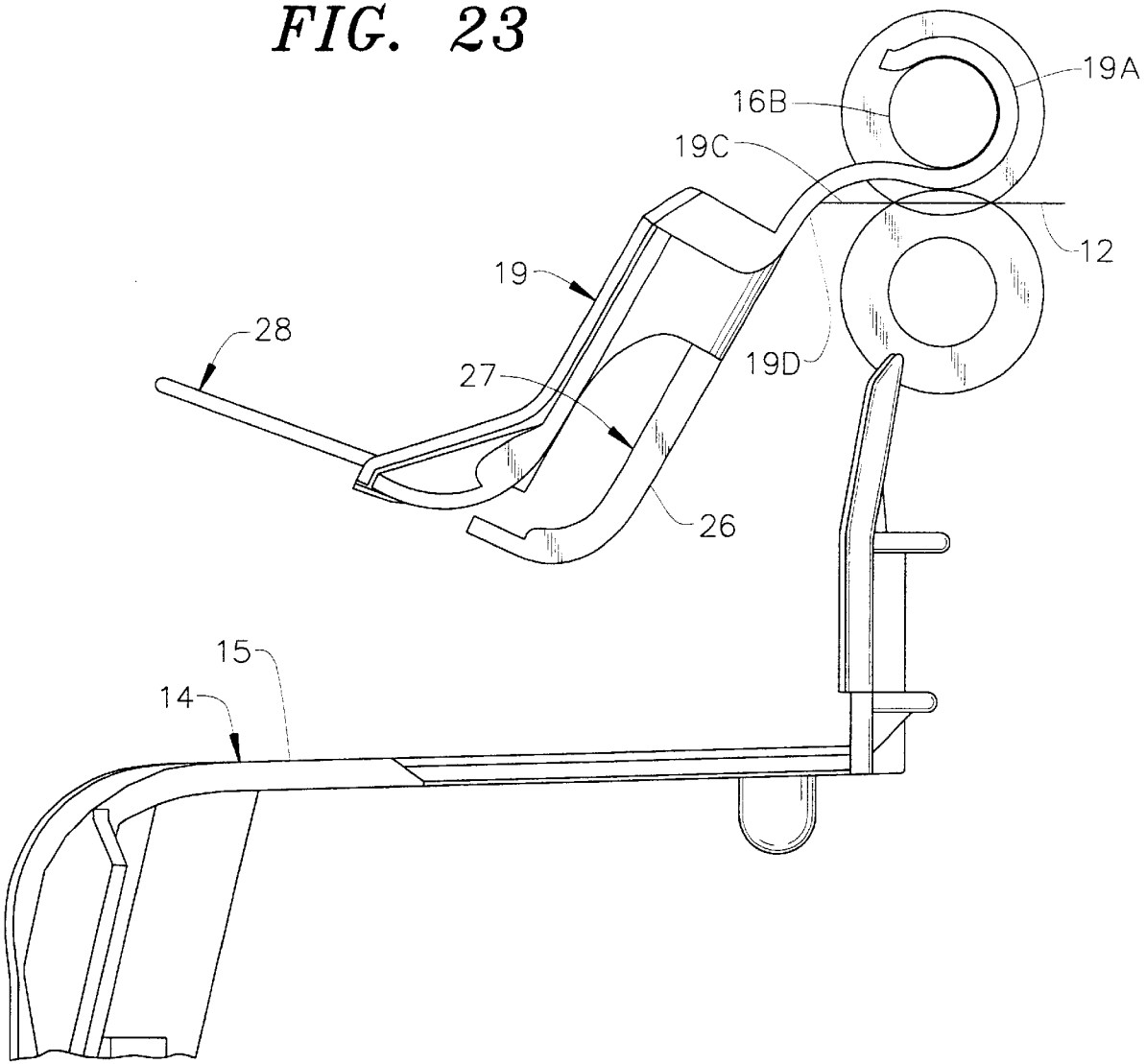
FIG. 23 is a side schematic view, similar to FIG. 22, with the bail actuator pivoted 20° from its position of FIG. 22.
Figure 25:
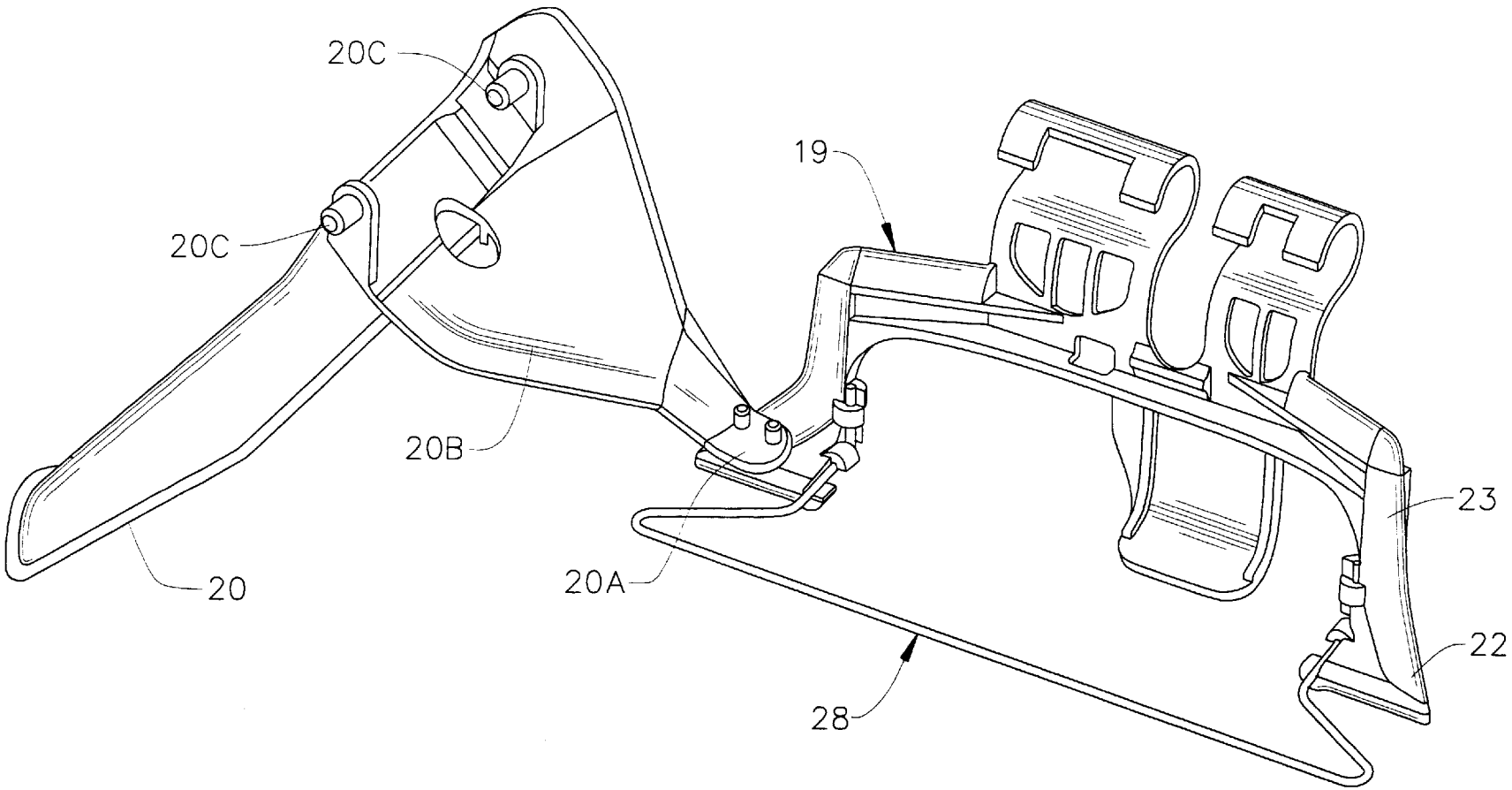
FIG. 25 is a perspective view showing the relation between the left bail and the bail actuator when the bail actuator has pivoted to its position of FIG. 23.

When the bail actuator 19 is in the position of FIG. 23, a cam surface 19E (see FIG. 21) at the bottom of a leg 19F of the bail actuator 19 causes pivotal movement of a left bail 20 (see FIG. 25) through the cam surface 19E engaging a cam surface (not shown) on the bottom surface of a bottom portion 20A of an actuation arm 20B of the left bail 20. The left bail 20 is pivotally mounted through two pivot pins 20C being supported in a mounting bracket 20D (see FIG. 3), which is attached to a top cover (not shown) supported on a side frame 20F (one shown in FIG. 1) of the finisher 11. This is more particularly shown and described in the aforesaid Gordon et al application, Ser. No. 09/779,852, which is incorporated by reference herein.

A right bail 21 (see FIG. 3) is similarly pivotally mounted by two pivot pins 21A being supported in a mounting bracket 21B, which also is attached to the top cover (not shown) supported on the side frame (one shown at 20F in FIG. 1) of the finisher 11. The right bail 21 has a cam surface (not shown) on the bottom surface of a bottom portion 21C (see FIG. 3) of an actuating arm 21D engaged by a cam surface 22 (see FIG. 21) at the bottom of a leg 23 of the bail actuator 19 for movement at the same time as the left bail 20 (see FIG. 3). Therefore, the bails 20 and 21 cooperate to support the printed sheet 12 (see FIG. 24) in the manner more particularly shown and described in the aforesaid Gordon et al application, Ser. No. 09/779,852.

Figure 24:
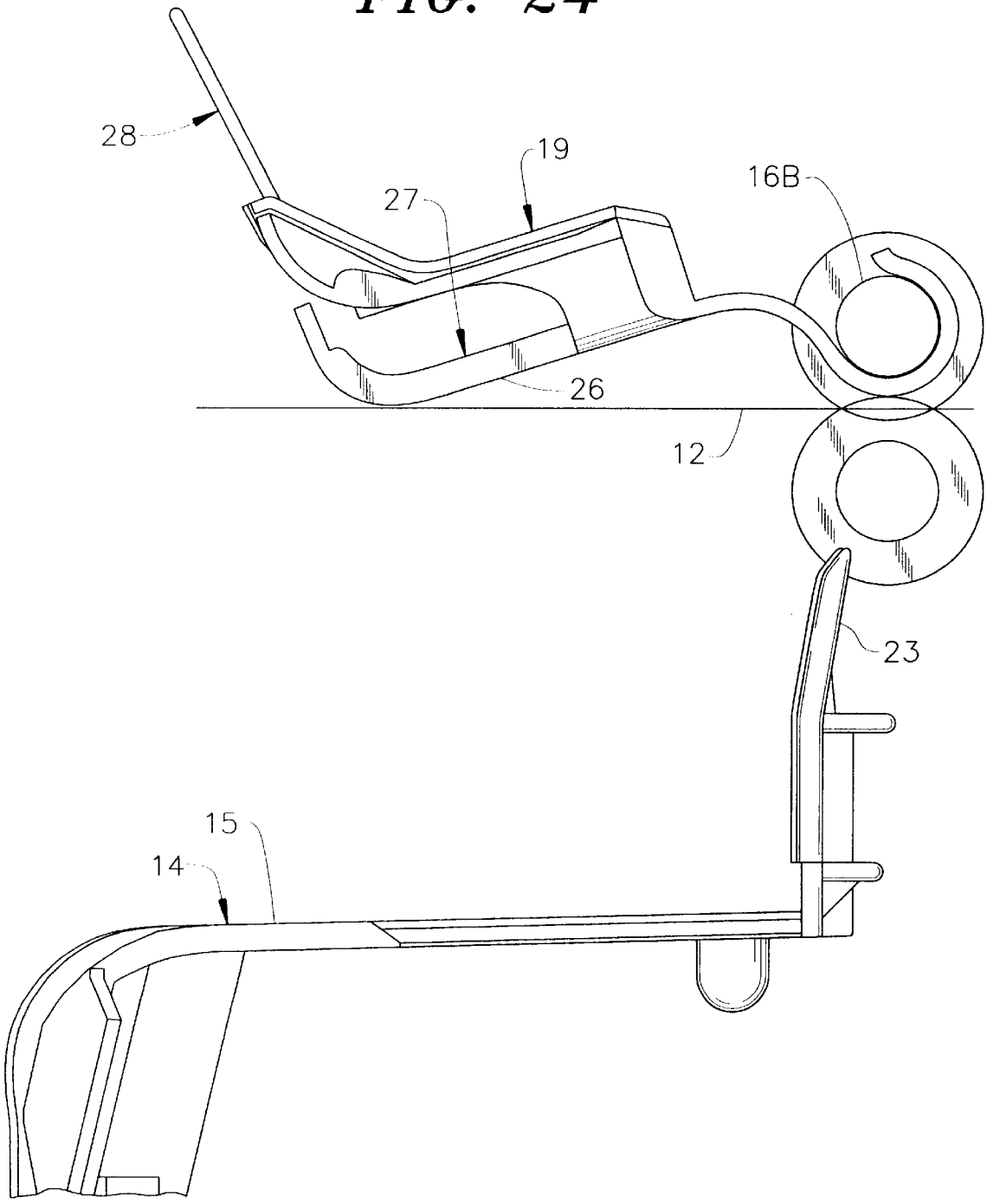
FIG. 24 is a side schematic view, similar to FIGS. 22 and 23, with the bail actuator at its maximum pivoted position prior to the sheet falling by gravity as it leaves the exit corrugation rollers.

The leading edge 19C (see FIG. 23) of the printed sheet 12 advances from the position of FIG. 23 until the bail actuator 19 reaches its maximum pivoted position of FIG. 24. The leading edge 19C (see FIG. 22) of the printed sheet 12 rode along the back surface 19D of each of the arcuate extensions 19A (see FIG. 21) and 19B until it reached a main portion 25 of the bail actuator 19. Thereafter, the leading edge 19C (see FIG. 23) of the printed sheet 12 rode along a back surface 26 of a sheet engaging member 27, which extends downwardly from the main portion 25 (see FIG. 21) of the bail actuator 19.

After reaching the position of FIG. 24 and rear edge 37 (see FIG. 4) of each of the printed sheets 12 exits the corrugation rollers 16A (see FIG. 2), 17A and 17B, the bail actuator 19 (see FIG. 24) begins to fall by gravity to cause pivoting of the bail actuator 19 about the axis of the shaft 16B so that the printed sheet 12 is removed from support by the bails 20 (see FIG. 3) and 21. This results in the bails 20 and 21 also pivoting downwardly by gravity due to the bail actuator 19 (see FIG. 21) pivoting downwardly by gravity.

The sheet engaging member 27 (see FIG. 24) of the bail actuator 19 pushes downwardly on the printed sheet 12. This causes the printed sheet 12 to fall by gravity to the upper support surface 15 of the accumulator table 14 and the inclined output tray 18 (see FIG. 2).

Figure 21:
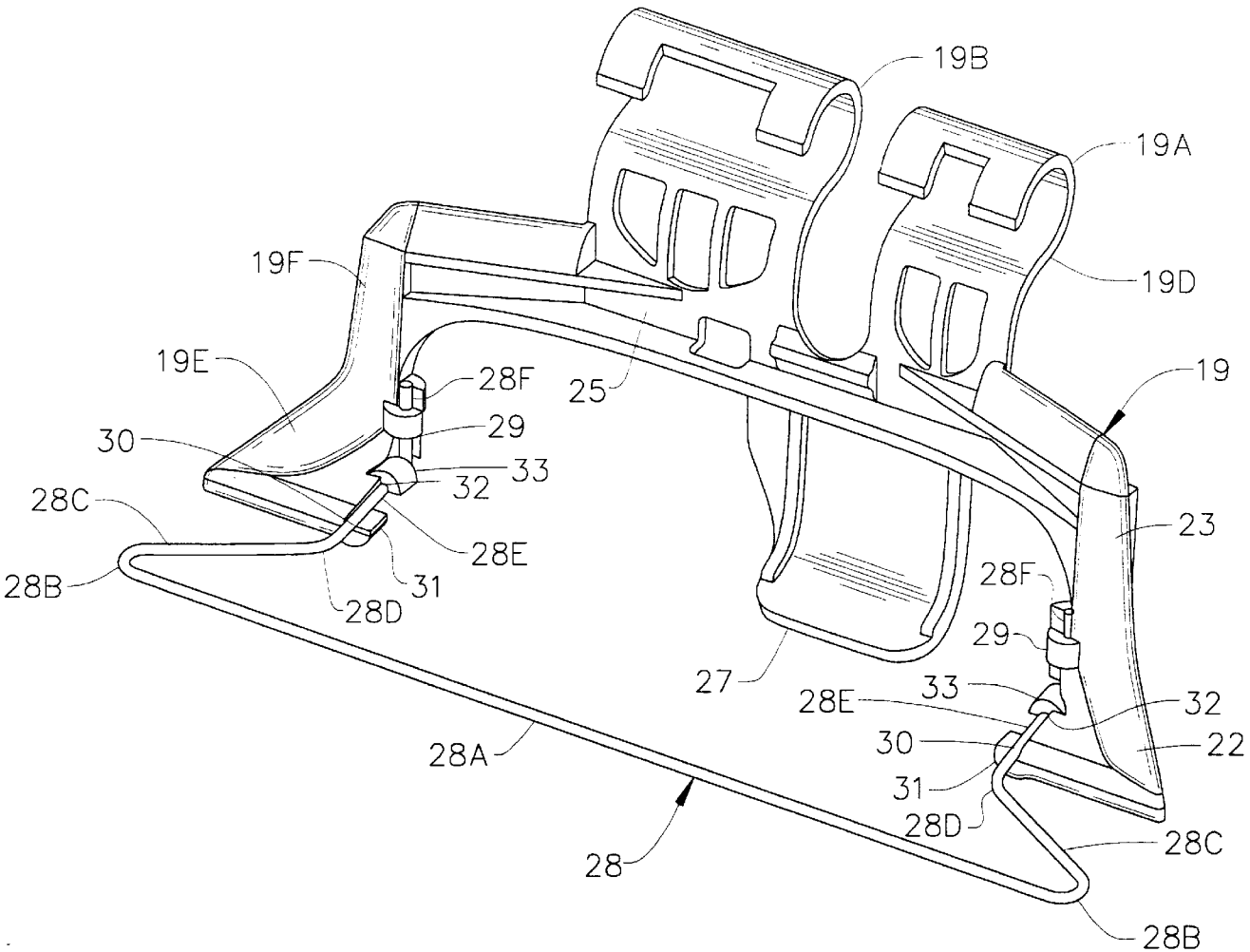
FIG. 21 is a perspective view of a bail actuator of the present invention used in the finisher.
Figure 22:
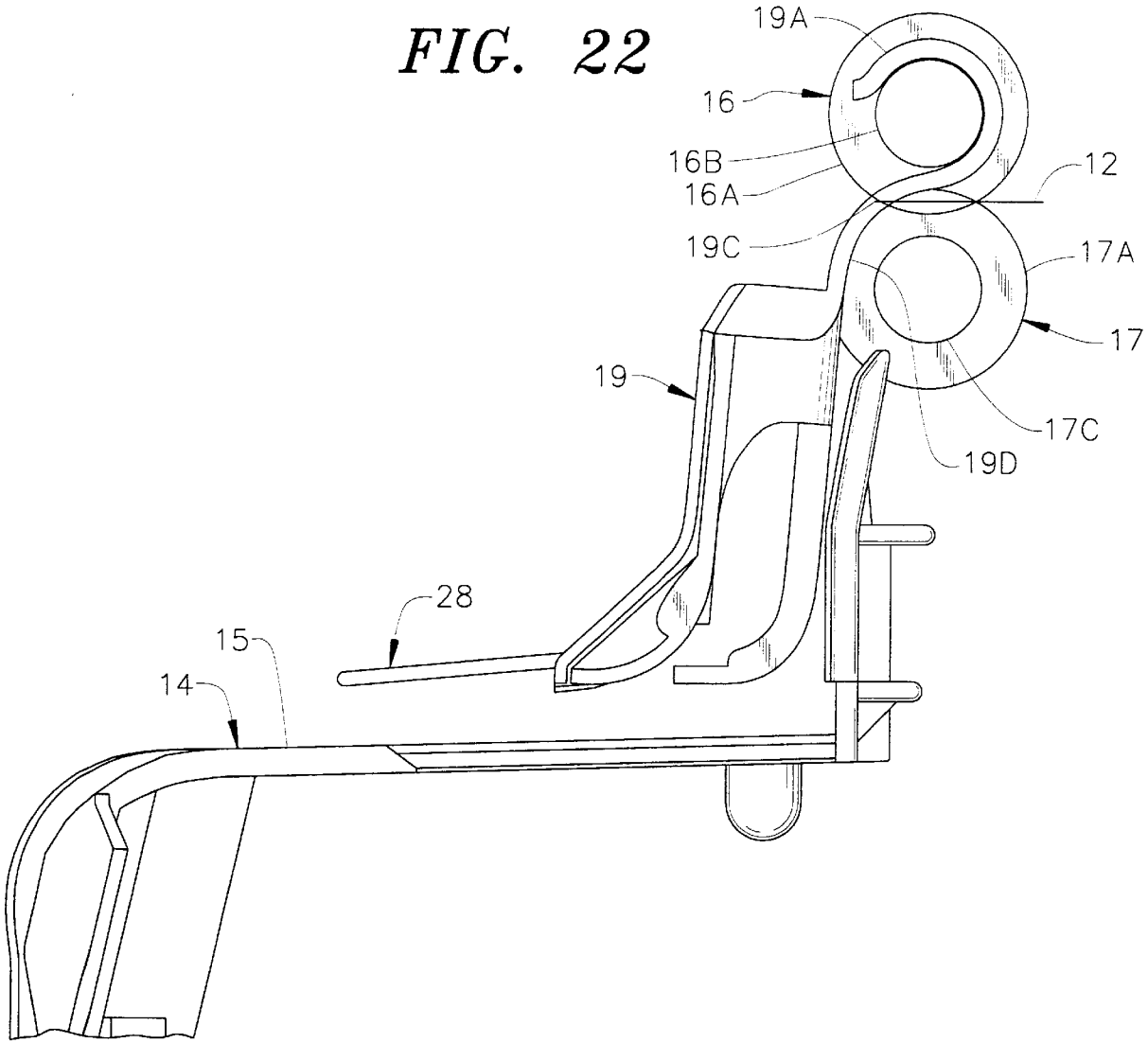
FIG. 22 is a side schematic view of a bail actuator in its rest or home position with a sheet beginning to exit from two sets of exit corrugation rollers.

As the bail actuator 19 (see FIG. 24) falls downwardly by gravity, a wire bail 28 engages the printed sheet 12. As shown in FIG. 21, the wire bail 28 includes a horizontal front portion 28A having a curved horizontal portion 28B at each end connected to an angled horizontal portion 28C. Each of the angled horizontal portions 28C is connected by a curved horizontal portion 28D to a rear horizontal portion 28E. Each of the rear horizontal portions 28E terminates in a vertical end portion 28F extending upwardly therefrom.

Each of the vertical end portions 28F is disposed in a retainer 29 mounted on each of the legs 19F and 23 of the bail actuator 19. This prevents horizontal movement of the wire bail 28.

The rear horizontal portion 28E has a snap fit in a groove 30 in an extension 31 of each of the legs 19F and 23 of the bail actuator 19 to prevent downward movement of the wire bail 28. The rear horizontal portion 28E also has a snap fit in a groove 32 in a retainer 33 on the extension 31 of each of the legs 19F and 23 of the bail actuator 19 to prevent upward movement of the wire bail 28.

The horizontal front portion 28A of the wire bail 28 preferably has a length of about five inches. It is desired that the horizontal front portion 28A of the wire bail 28 extend as wide as possible.

The horizontal front portion 28A of the wire bail 28 breaks any longitudinal beam created in the printed sheet 12 (see FIG. 24) because of a curl created in the printed sheet 12 by a fuser (not shown) of the printer 10 (see FIG. 1), for example. This occurs after the printed sheet 12 (see FIG. 24) falls by gravity and is supported on the upper support surface 15 of the accumulator table 14.

This is because the fuser (not shown) of the printer 10 creates a longitudinally extending curl in the printed sheet 12 to form the beam or arch along the entire length of the printed sheet 12 with a downwardly facing arch. The horizontal front portion 28A (see FIG. 21) of the wire bail 28 breaks the longitudinal beam, if it exists, in the printed sheet 12 (see FIG. 24) after it is supported on the upper support surface 15 of the accumulator table 14. The horizontal front portion 28A (see FIG. 21) of the wire bail 28 creates a beam in the direction of the width of the printed sheet 12 (see FIG. 24) with a desired upwardly facing arch configuration. This upwardly facing arch of the printed sheet 12 increases the beam strength of each of the printed sheets 12 in the direction of alignment in which each of the printed sheets 12 is moved.

Figure 26:
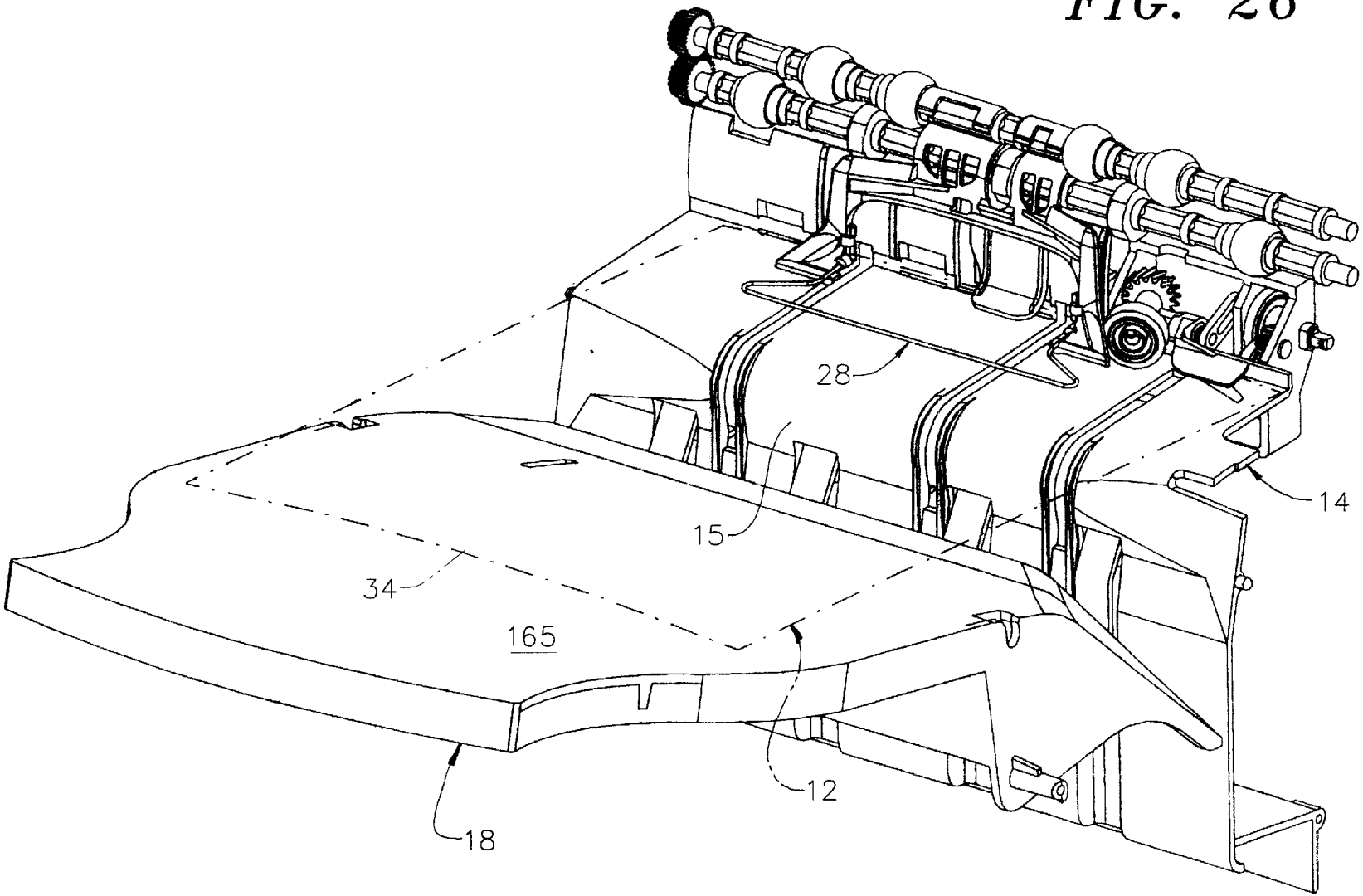
FIG. 26 is a right side perspective view that is the same as FIG. 2 except that a printed sheet is shown in phantom with a downwardly facing arch extending the length of the sheet.
Figure 27:
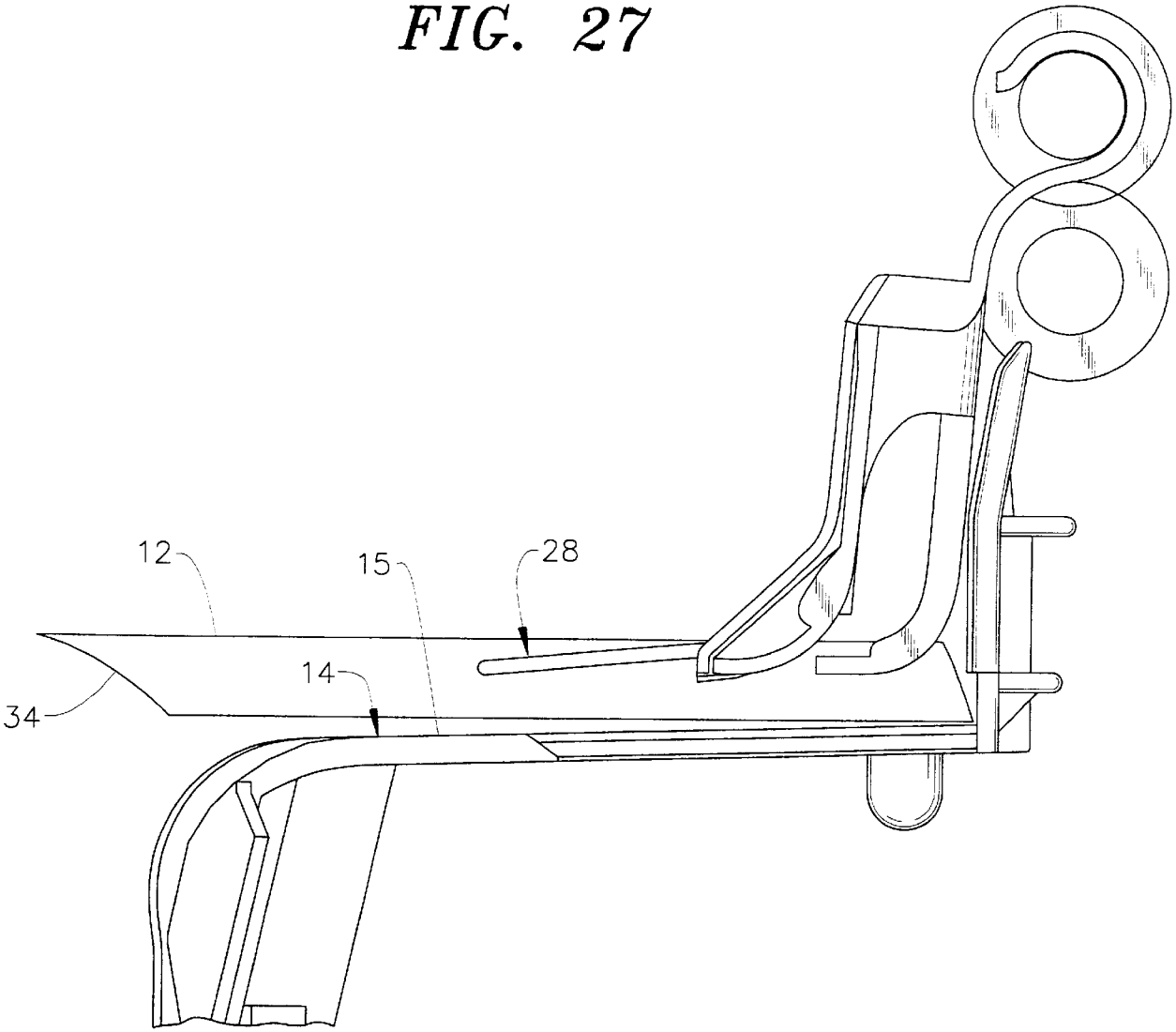
FIG. 27 is a side schematic view that is the same as FIG. 22 except that a printed sheet is shown in phantom with a downwardly facing arch extending the length of the sheet.

The downwardly facing arch in the printed sheet 12 is shown in FIGS. 26 at 34 and is larger than shown. It also is shown in FIG. 27. FIG. 26 also shows the printed sheet 12 not falling by gravity in the desired shape because of the longitudinal beam in the printed sheet 12.

Figure 12:
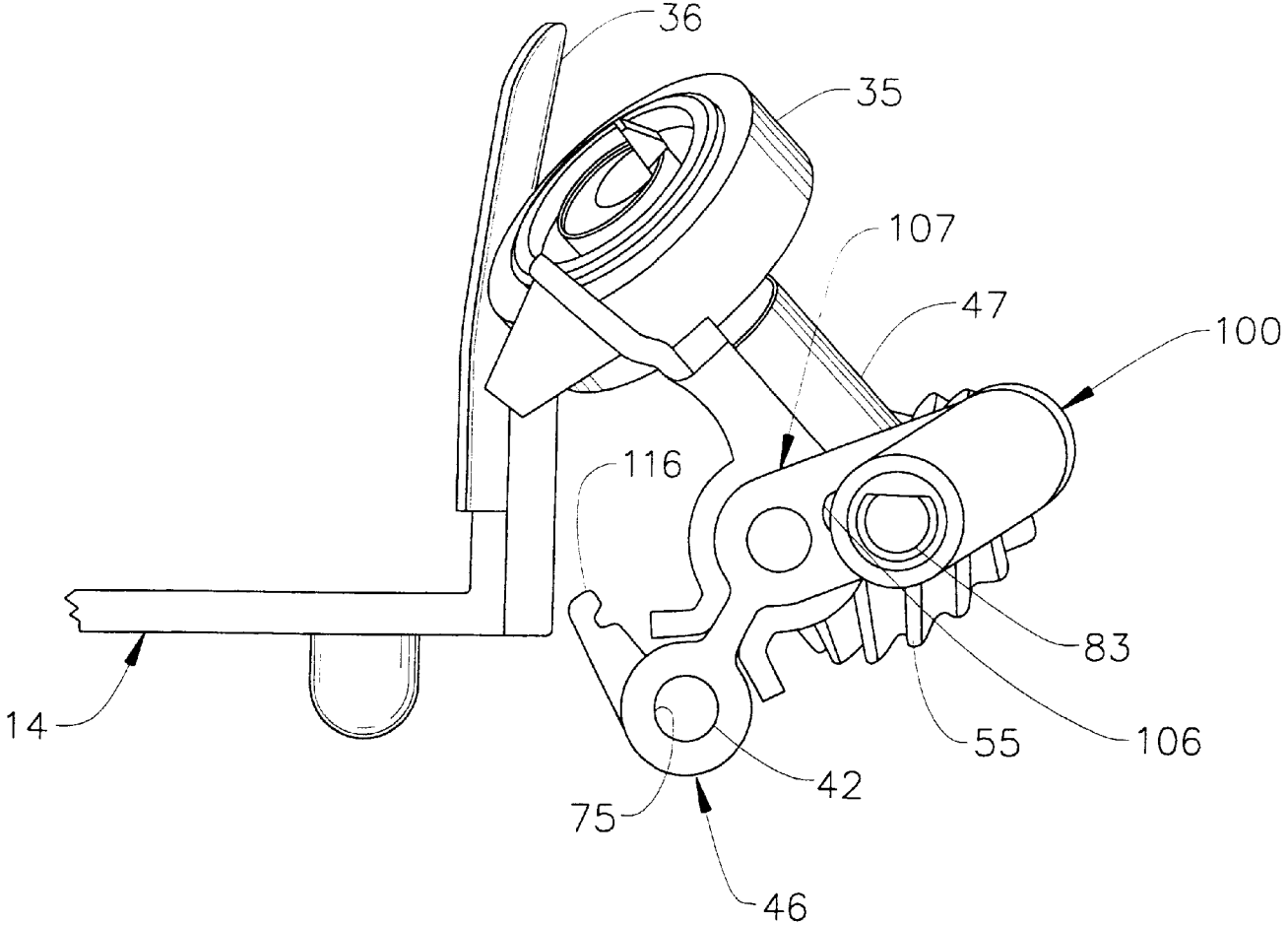
FIG. 12 is a fragmentary side elevation view of the aligning roller in its home or rest position in which the aligning roller does not rotate, a portion of the accumulator table on which each printed sheet is supported, and a driving crank.

When each of the printed sheets 12 (see FIG. 2) falls by gravity onto the upper support surface 15 of the accumulator table 14, an aligning roller 35 must be maintained in an elevated position, which is its home position of FIG. 12, to enable the printed sheet 12 (see FIG. 2) to fall by gravity onto the accumulator table 14. The aligning roller 35 is shown in FIG. 2 in its frictional contact position with the printed sheet 12 to be advanced by the aligning roller 35.

The accumulator table 14 includes a rear wall 36, which is substantially perpendicular to the upper support surface 15. The rear wall 36 functions as a rear reference barrier for engagement by the rear edge 37 (see FIG.4) of each of the printed sheets 12.

The rear edge 37 of the printed sheet 12 must be within 10 mm. of the rear wall 36 (see FIG. 2) of the accumulator table 14. There is preferably only 4 mm. between the rear edge 37 (see FIG. 4) of the printed sheet 12 and the rear wall 36 of the accumulator table 14 (see FIG. 2). If the spacing is greater than 10 mm., the aligning roller 35 cannot advance the printed sheet 12 in the manner shown in FIGS. 4–6.

Figure 10:
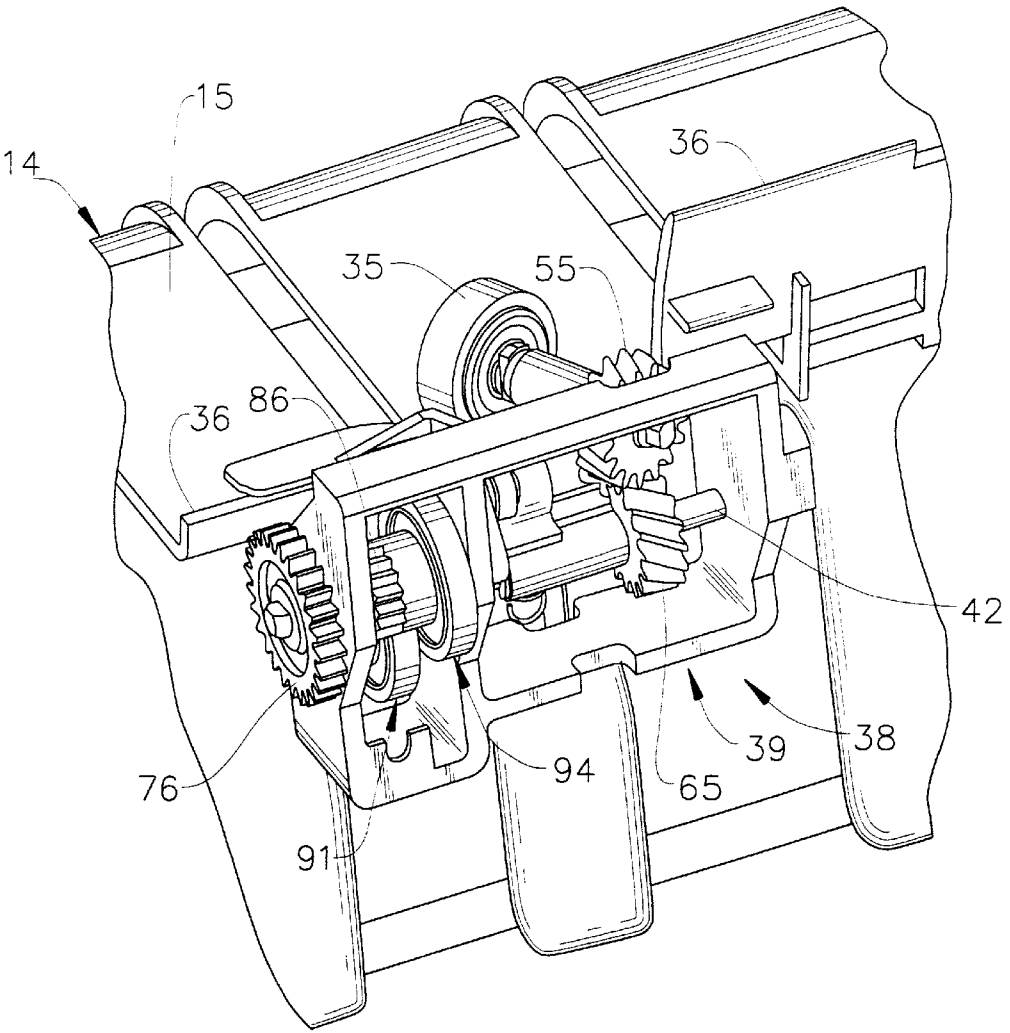
FIG. 10 is a rear perspective view of a portion of the finisher of FIG. 7 showing the sheet aligning assembly of FIG. 7 disposed relative to the accumulator table of the finisher.
Figure 13:
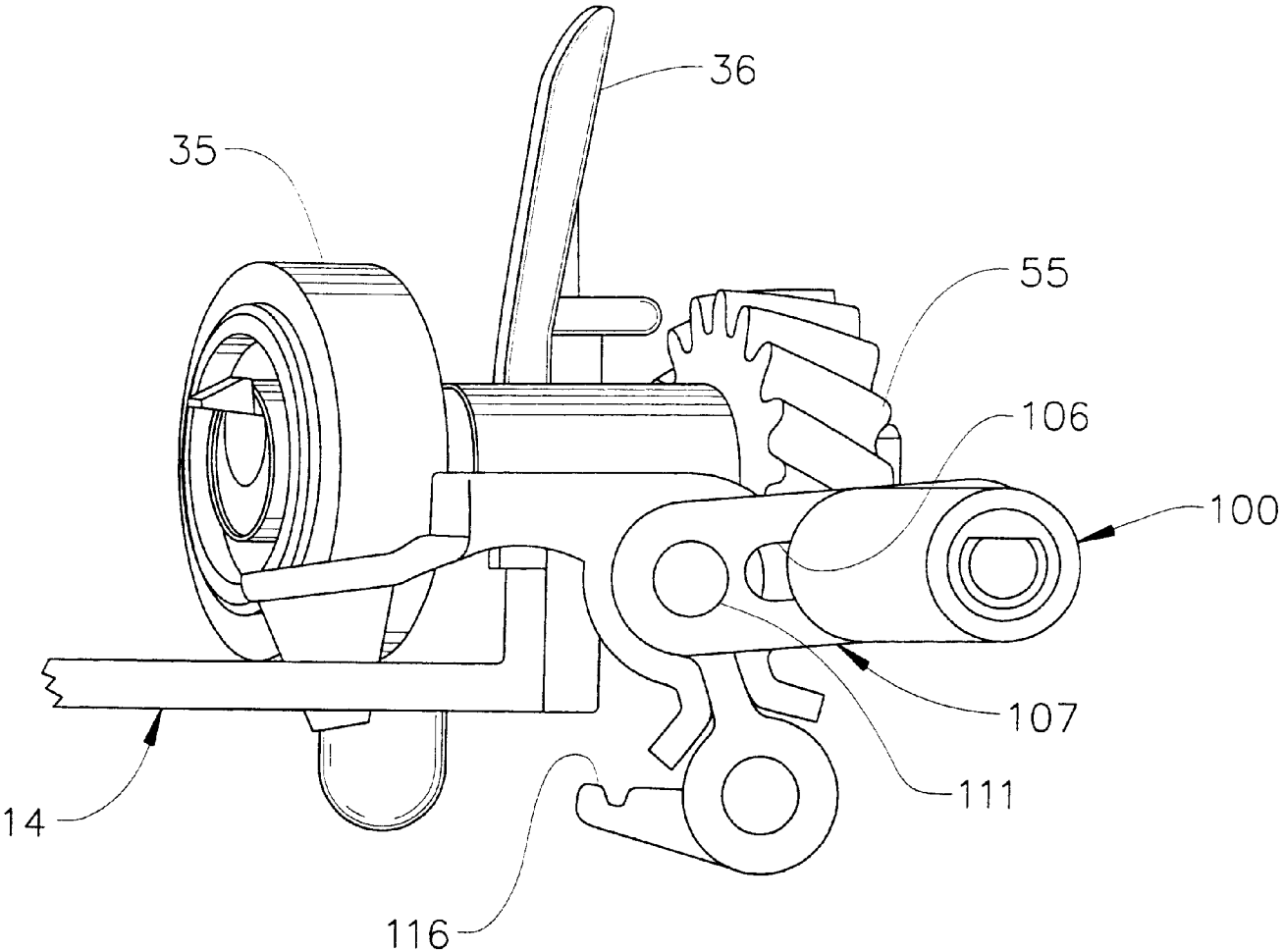
FIG. 13 is a fragmentary side elevation view, similar to FIG. 12, of the aligning roller in its frictional contact position with a printed sheet for advancing the printed sheet to its aligned position, the portion of the accumulator table, and the driving crank advanced 180° from its home position of FIG. 12.
Figure 14:
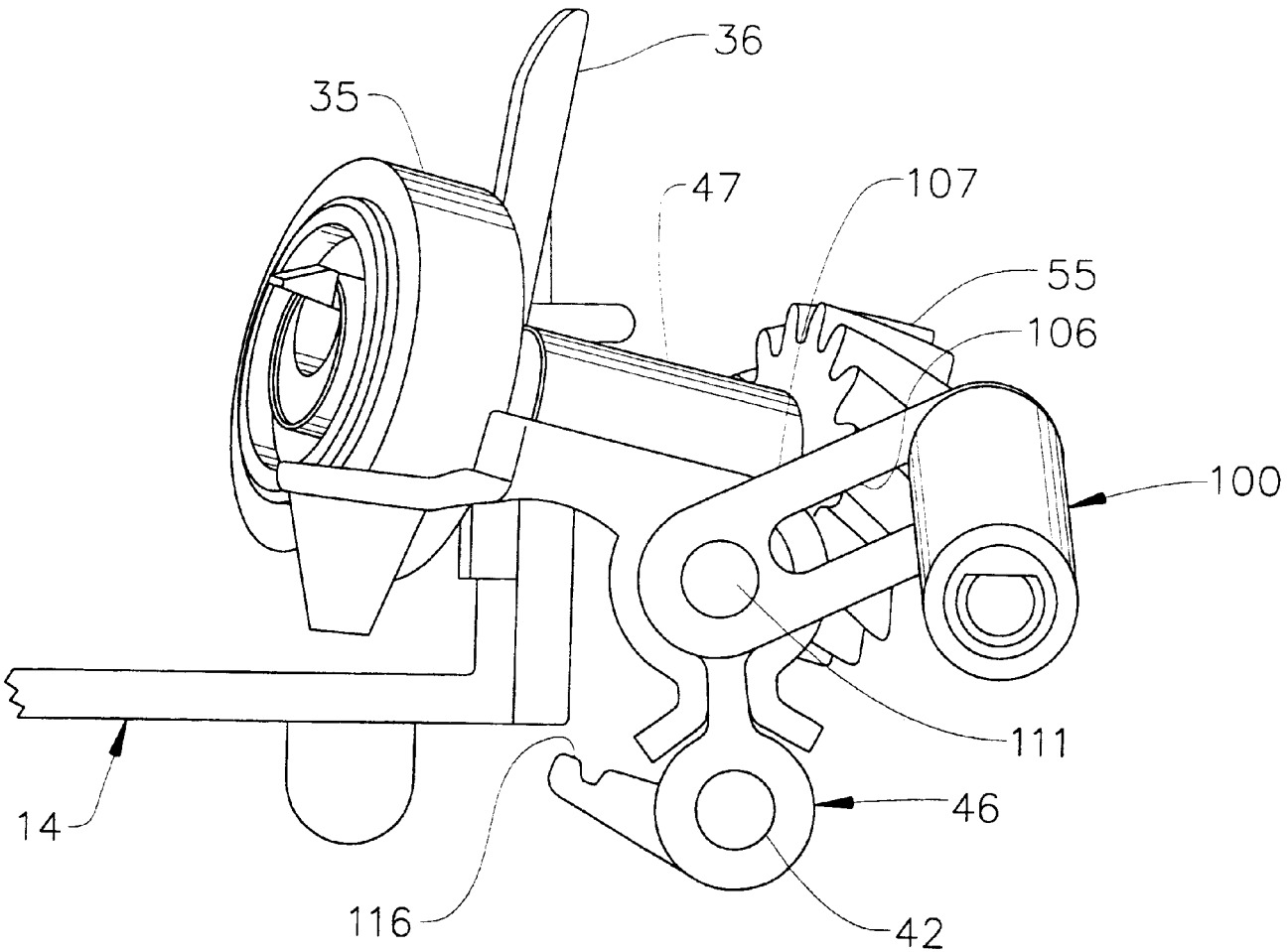
FIG. 14 is a fragmentary side elevation view, similar to FIG. 13, of the aligning roller, the portion of the accumulator table with the aligning roller removed from its sheet contact position in FIG. 13, and the driving crank advanced 90° from its position in FIG. 13 but 90° prior to its position in FIG. 12.
Figure 15:
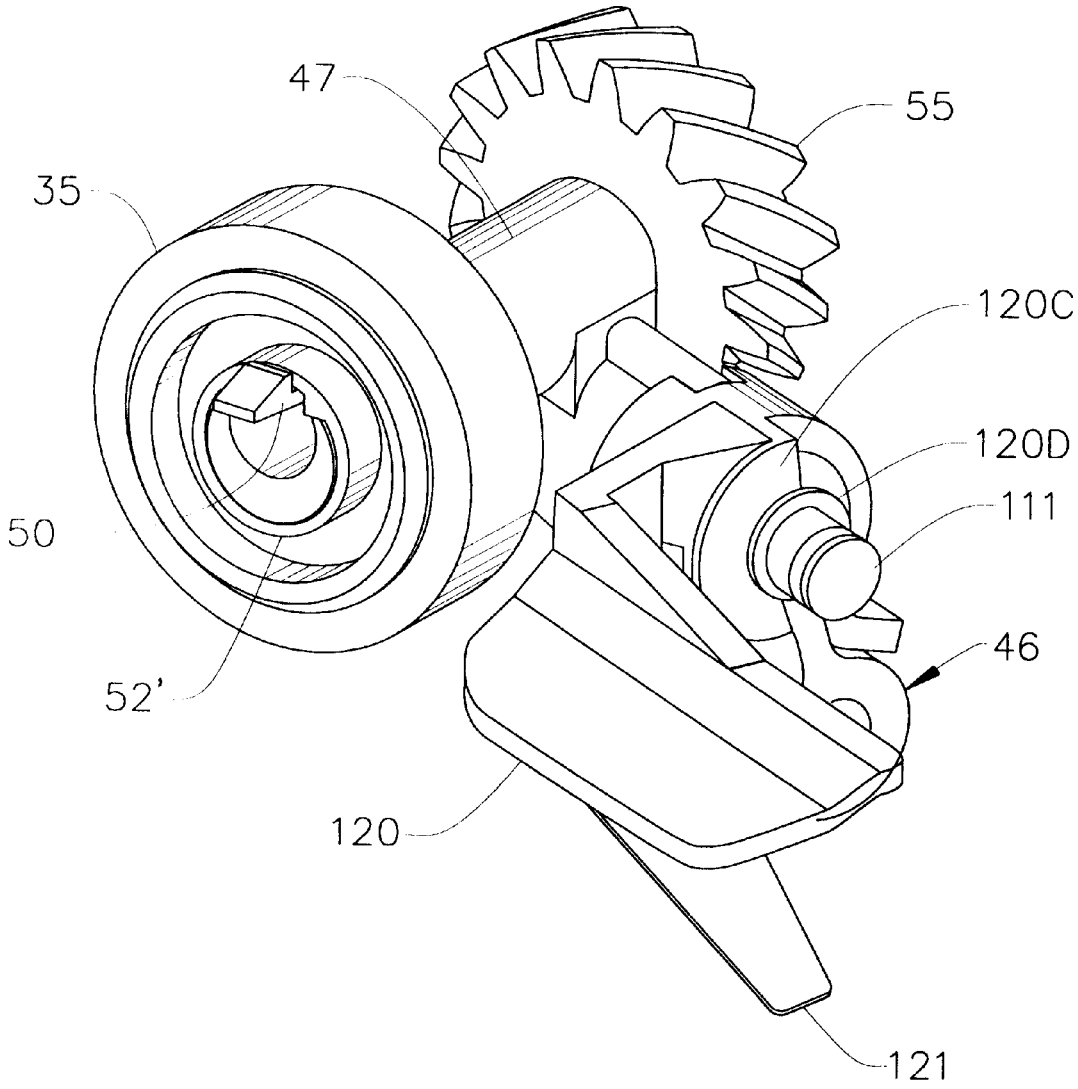
FIG. 15 is a perspective view of a sub-assembly of the aligning roller and its support.
Figure 16:
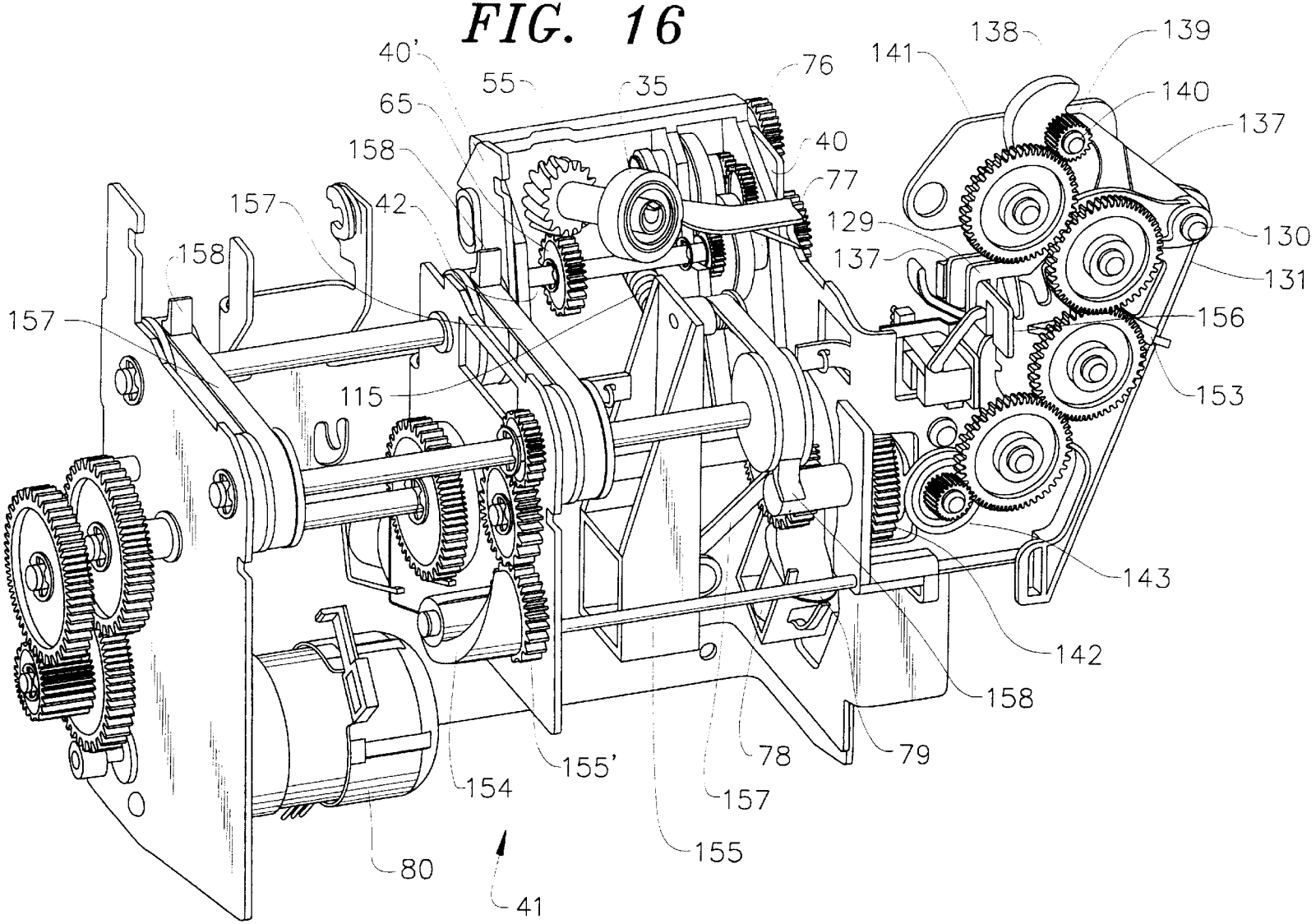
FIG. 16 is a front perspective view of a gear box of the finisher including a gear train for driving various portions of the finisher during each cycle of operation.

The aligning roller 35 is supported by a sheet aligning assembly 38 (see FIG. 7) for movement from its home position, which is shown in FIG. 12, to its frictional contact position, which is shown in FIG. 13, for engagement with each of the printed sheets 12 (see FIG. 4) and then returned to its home position. The sheet aligning assembly 38 (see FIG. 10) includes a frame 39, which is supported by walls 40 (see FIG. 16) and 40' of a gear box 41.

Figure 7:
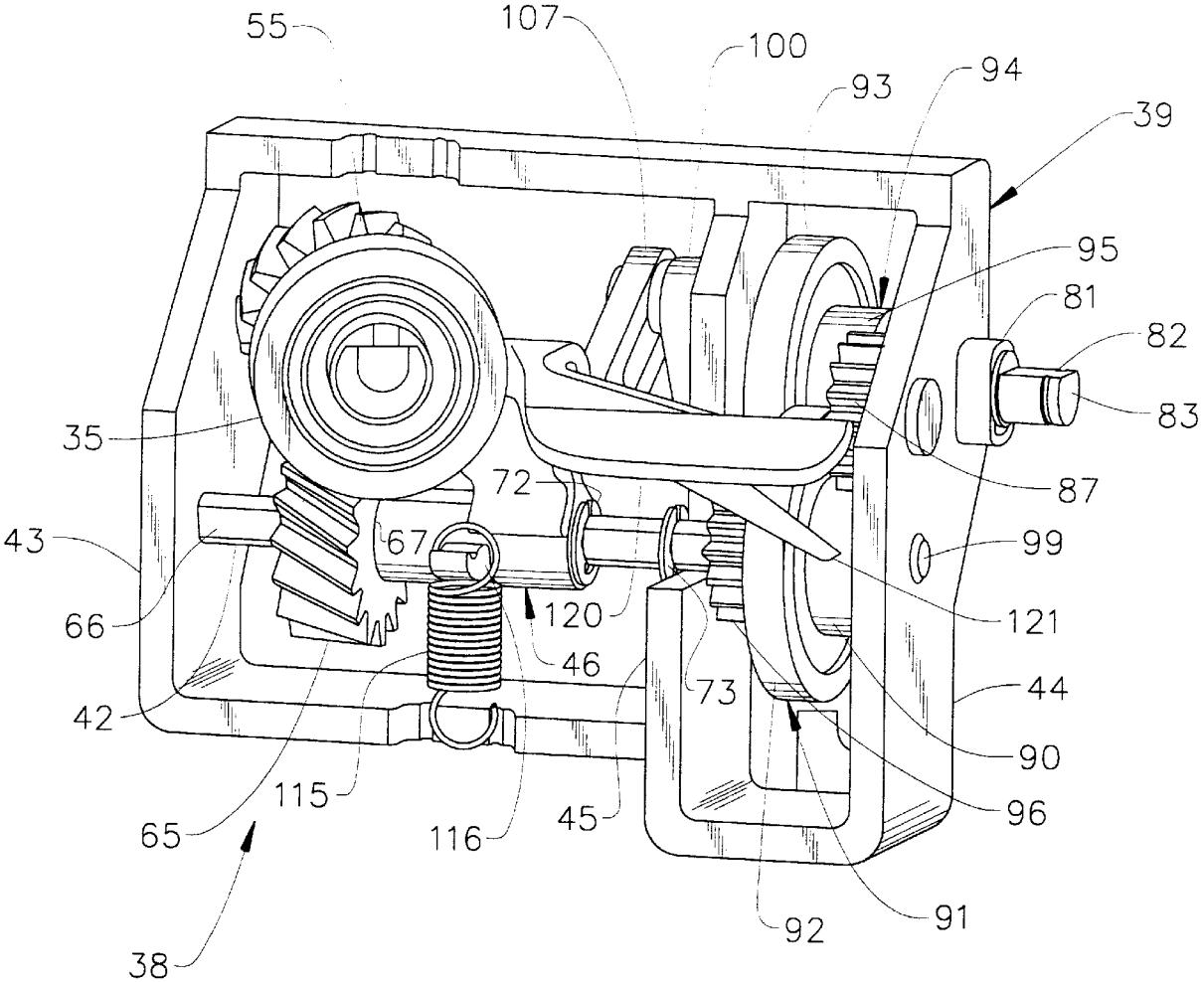
FIG. 7 is a perspective view of a sheet aligning assembly of the finisher.

As shown in FIG. 7, the frame 39 has a main shaft 42 rotatably supported in its end walls 43 and 44. The frame 39 has an intermediate wall 45 between the end walls 43 and 44.

Figure 9:
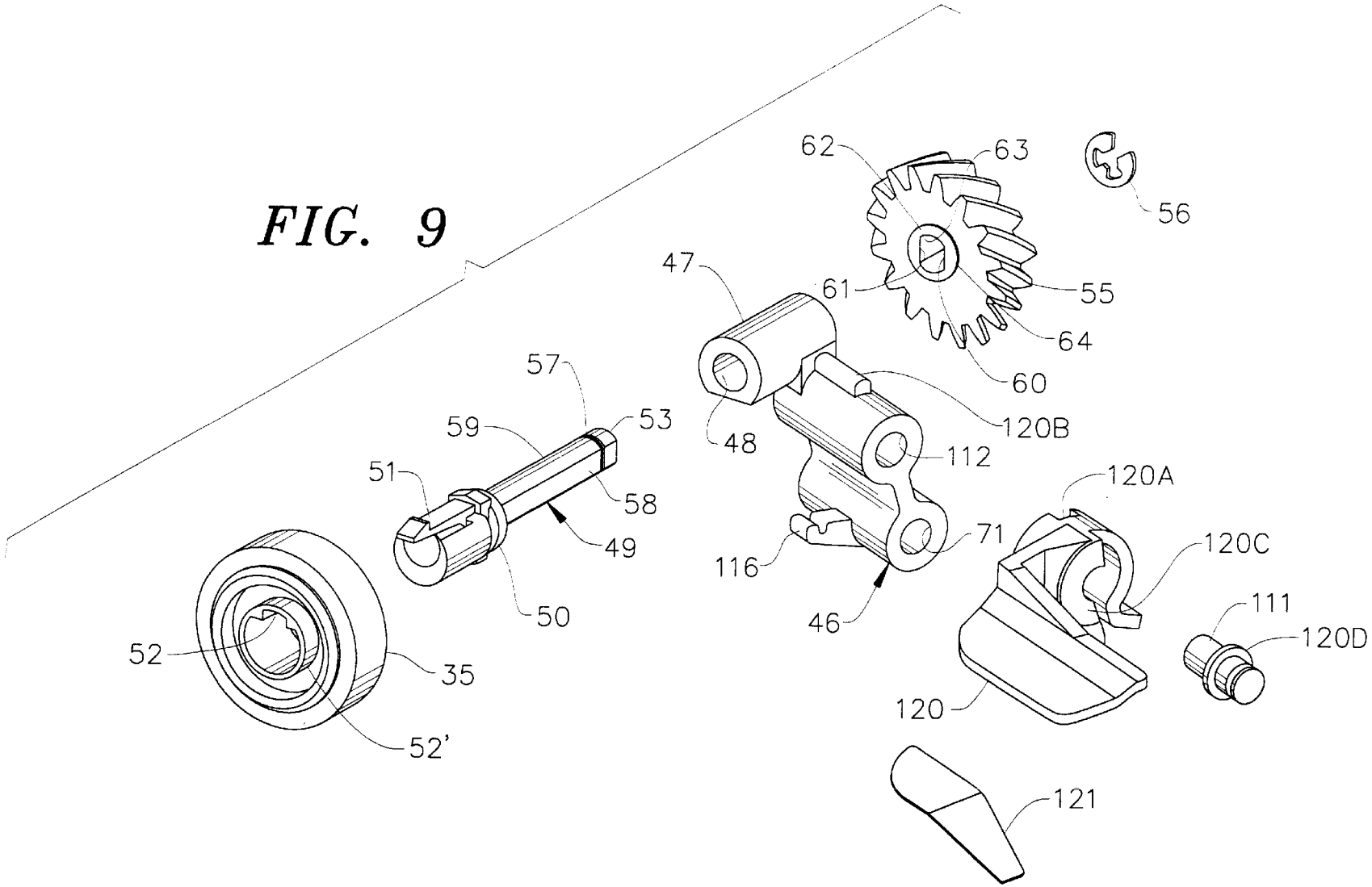
FIG. 9 is an exploded perspective view of a sub-assembly of the sheet aligning assembly of FIG. 8 including a pivotally mounted housing and the aligning roller supported by the pivotally mounted housing.

A housing 46 is mounted on the main shaft 42 for pivotal movement in both directions about the axis of the main shaft 42. The pivotally mounted housing 46 includes a cylindrical portion 47 (see FIG. 9) having a circular passage 48 extending therethrough.

A roller shaft 49 is rotatably supported in the circular passage 48 of the cylindrical portion 47 of the pivotally mounted housing 46. The roller shaft 49 has the aligning roller 35 retained on its enlarged end 50 by a resilient finger 51 disposed in a slot 52 in a hub 52' of the aligning roller 35 and engaging the hub 52'. This connection causes rotation of the aligning roller 35 only when the roller shaft 49 is rotated.

The roller shaft 49 has its other end 53 extending beyond the cylindrical portion 47 of the housing 46 to support a helical gear 55. The helical gear 55 is held on the roller shaft 49 (see FIG. 11) by a C-clip 56 disposed in a groove 57 (see FIG. 9) in the roller shaft 49.

The roller shaft 49 has flat side portions 58 and 59 against which flat side portions 60 and 61, respectively, of a circular passage 62 extending through the helical gear 55 engage. Accordingly, when the helical gear 55 is rotated, the roller shaft 49 rotates to rotate the aligning roller 35. Each side of the helical gear 55 has a boss 64 (one shown in FIG. 9) extending slightly beyond the remainder of each side of the helical gear 55.

Figure 8:
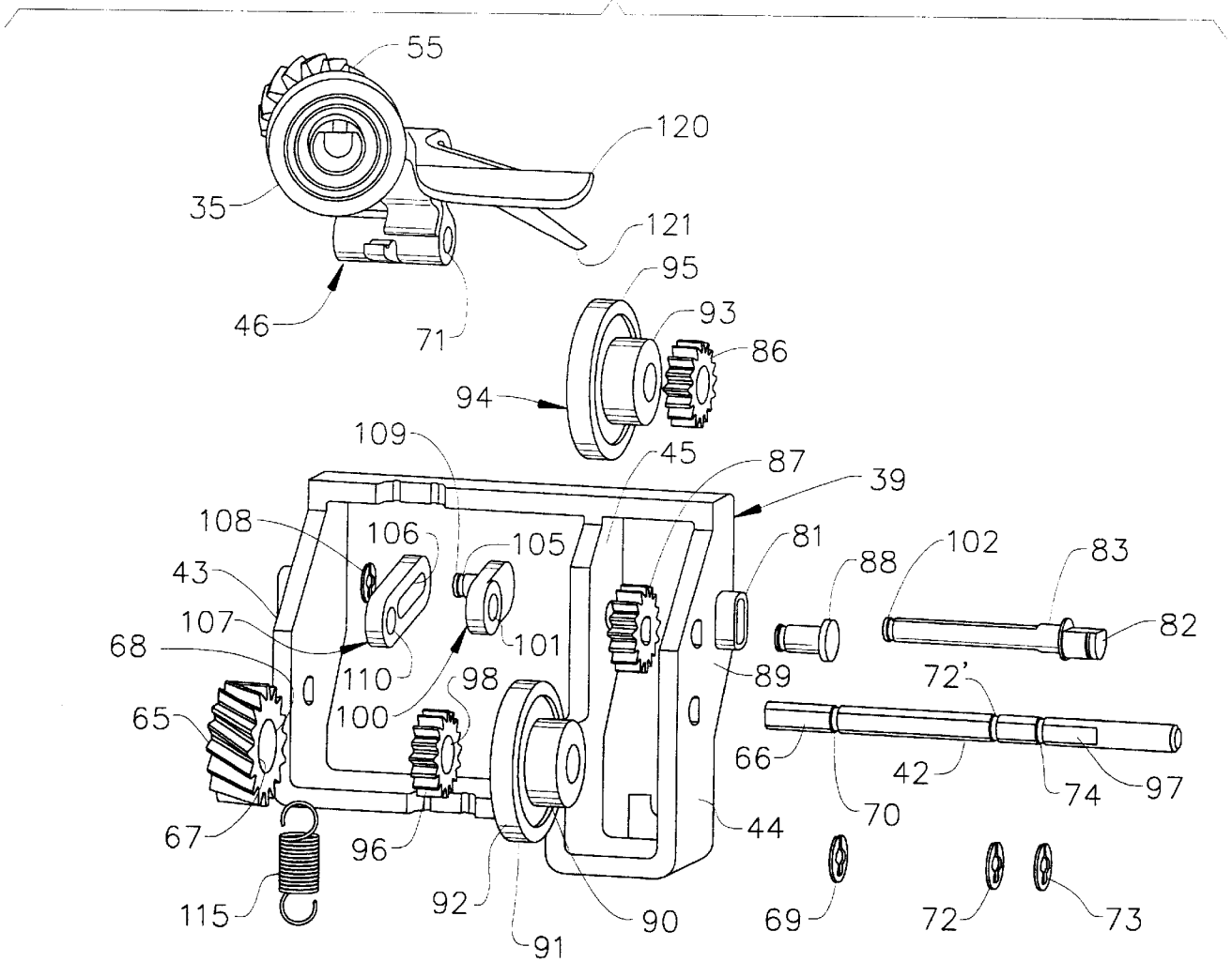
FIG. 8 is an exploded perspective view of the sheet aligning assembly of FIG. 7.

The helical gear 55 meshes with a helical gear 65 (see FIG. 7). The helical gear 65 is mounted on the main shaft 42 to be driven thereby. The helical gear 65 rotates with the main shaft 42 through flat side portions (one shown at 66 in FIGS. 7 and 8) on the main shaft 42 engaging cooperating flat side portions (not shown) of a circular passage 67 (see FIG. 8) in the helical gear 65. Each side of the helical gear 65 has a boss 68 (one shown in FIG. 8) extending slightly beyond the remainder of the helical gear 65.

A C-clip 69 is disposed in a groove 70 in the main shaft 42 to position the helical gear 65 on the main shaft 42 through limiting its axial movement to the left in FIG. 7. This insures that the teeth of the helical gear 65 and the teeth of the helical gear 55 will always mesh.

The pivotally mounted housing 46 (see FIG. 9) has a circular passage 71 to receive the main shaft 42 (see FIG. 7). This mounts the housing 46 on the main shaft 42 so that it may pivot in either direction on the main shaft 42.

The pivotally mounted housing 46 is disposed next to the helical gear 65 but slightly spaced therefrom because of the boss 68 (see FIG. 8) on the helical gear 65 engaging the adjacent side of the pivotally mounted housing 46 (see FIG. 7). A C-clip 72 (see FIG. 8) is disposed in a groove 72' in the main shaft 42 to hold the pivotally mounted housing 46 (see FIG. 7) on the main shaft 42 by limiting its axial movement to the right. Thus, the housing 46 is pivotally mounted on the main shaft 42 so that it can pivot relative to the main shaft 42 in either a clockwise or counterclockwise direction as the main shaft 42 is rotated in only one direction.

A C-clip 73 (see FIG. 8) is disposed in a groove 74 in the main shaft 42. The C-clip 73 engages the left (as viewed in FIG. 7) side of the intermediate wall 45 of the frame 39 to prevent movement of the main shaft 42 to the right.

The main shaft 42 is driven by a gear 76 (see FIGS. 10, 11, and 16) having its teeth mesh with teeth on a gear 77 (see FIG. 16) of a gear train in the gear box 41 of the finisher 11 (see FIG. 1). When an electromagnet 78 (see FIG. 16) of a clutch 79 is energized, a DC motor 80 causes rotation of the gear 76. This drives the main shaft 42 at a predetermined velocity during each cycle of operation.

A hollow projecting guide 81 (see FIG. 8) on the end wall 44 of the frame 39 is disposed within a corresponding shaped opening (not shown) in the wall 40 (see FIG. 16) of the gear box 41. This alignment insures that the gears 76 and 77 mesh satisfactorily.

The gear 76 (see FIG. 10) is mounted on a flattened end 82 (see FIG. 7) of a drive shaft 83 extending through the hollow projecting guide 81 on the exterior of the end wall 44 of the frame 39. The drive shaft 83 extends through the opening (not shown) in the wall 40 (see FIG. 16) of the gear box 41 to insure that the gear 76 is disposed within the gear box 41.

As shown in FIG. 7, the drive shaft 83 extends through a passage in the hollow projecting guide 81. The drive shaft 83 is rotatably supported in each of the end wall 44 and the intermediate wall 45 of the frame 39.

A drive gear 86 (see FIG. 8) is attached to the drive shaft 83. The drive gear 86 meshes with an idler gear 87.

The idler gear 87 is rotatably supported on a stub shaft 88, which extends through an opening 89 in the end wall 44 of the frame 39 to receive the idler gear 87. The idler gear 87 meshes with a smaller gear 90 of a compound gear 91.

The compound gear 91 is rotatably mounted on the main shaft 42. The compound gear 91 has its larger gear 92 mesh with a smaller gear 93 of a compound gear 94, which is rotatably mounted on the drive shaft 83.

The compound gear 94 has its larger gear 95 mesh with a drive gear 96, which is attached to the main shaft 42 for causing rotation thereof. Flat side portions 97 (one shown in FIG. 8) of the main shaft 42 cooperate with flat side portions (not shown) in a circular passage 98 in the drive gear 96.

The drive shaft 83 (see FIG. 8) has a crank 100 attached thereto through the drive shaft 83 being disposed in a hole 101 in the crank 100. The hole 101 is smaller at its end remote from the intermediate wall 45 of the housing 39 so that an end 102 of the drive shaft 83 engages this reduced portion of the hole 101 to have fixed engagement therewith.

The direct connection of the crank 100 to the drive shaft 83 results in the crank 100 rotating at a much slower velocity than the main shaft 42. The main shaft 42 makes approximately 3.75 revolutions per cycle of operation of the drive shaft 83, and the connected crank 100 rotates only one revolution per cycle of operation since the drive shaft 83 makes only one revolution per cycle of operation.

The crank 100 has a pin 105 formed integral therewith and extending through a longitudinal slot 106 in a link 107. A C-clip 108 is disposed in a groove 109 in the pin 105 of the crank 100 to maintain the pin 105 in sliding relation with the link slot 106. The link 107 has a circular passage 110 extending therethrough to receive a connecting pin 111 (see FIG. 9) extending through the circular passage 110 (see FIG. 8) into a circular passage 112 (see FIG. 9) in the housing 46 with which the connecting pin 111 has a press fit.

Rotation of the crank 100 (see FIG. 8) by the drive shaft 83 imparts pivotal motion to the housing 46 (see FIG. 7) during each cycle of operation. A spring 115 extends between a spring anchor 116 on the housing 46 and a portion (not shown) of the gear box 41 (see FIG. 16). This results in the spring 115 (see FIG. 7) continuously exerting a force on the pivotally mounted housing 46 so that a force is continuously exerted on the aligning roller 35 when it is in contact with the sheet 12 (see FIG. 11).

Thus, the spring 115 (see FIG. 7) continuously urges the pivotally mounted housing 46 away from the home position, as shown in FIG. 12, of the aligning roller 35 supported thereby. As a result, the force of the spring 115 (see FIG. 7) continuously causes the aligning roller 35 to exert a maximum normal force of a predetermined amount such as 50–60 grams, for example, on each of the printed sheets 12 (see FIG. 4) when the aligning roller 35 (see FIG. 7) comes in frictional contact therewith. This frictional contact position of the aligning roller 35 is shown in FIG. 13.

While the spring 115 (see FIG. 7) is the preferred force exerting means on the aligning roller 35, it should be understood that other suitable force exerting means such as a counterweight, for example may be employed, if desired. While the crank 100 (see FIG. 8) is preferred, it should be understood that a cam and a cam follower may be employed for controlling pivotal movement of the housing 46, if desired.

The housing 46 (see FIG. 9) also supports a deflector 120 for deflecting each of the printed sheets 12 (see FIG. 2) as each of the printed sheets 12 is aligned on the support surface 15 (see FIG. 2) of the accumulator table 14. This prevents each of the printed sheets 12 (see FIG. 11) from buckling upwardly when its side edge 123 engages an adjacent side reference barrier 122.

Additionally, a tongue 121 (see FIG. 9), which is preferably a polyester film sold under the trademark MYLAR, is adhered to the bottom of the deflector 120 by a suitable adhesive. The tongue 121, which preferably has a thickness of 0.004", rides on each of the printed sheets 12 (see FIG. 2) to prevent the printed sheet 12 from riding up the rear wall 36 of the accumulator table 14 during alignment.

The deflector 120 (see FIG. 9) has a slot 120A to receive a projection 120B on the housing 46 to prevent rotation of the deflector 120. A flange 120C on the deflector 120 engages the end of the housing 46 to limit movement of the deflector 120 onto the housing 46. A flange 120D on the connecting pin 111 engages the flange 120C on the deflector 120 when the connecting pin 111 has a press fit in the connecting pin 111.

The teeth of each of the helical gear 55 (see FIG. 7) and the helical gear 65 preferably have the same angle. However, there may be a slight difference between the angles of the teeth of the helical gear 55 and the helical gear 65, if desired.

Figure 11:
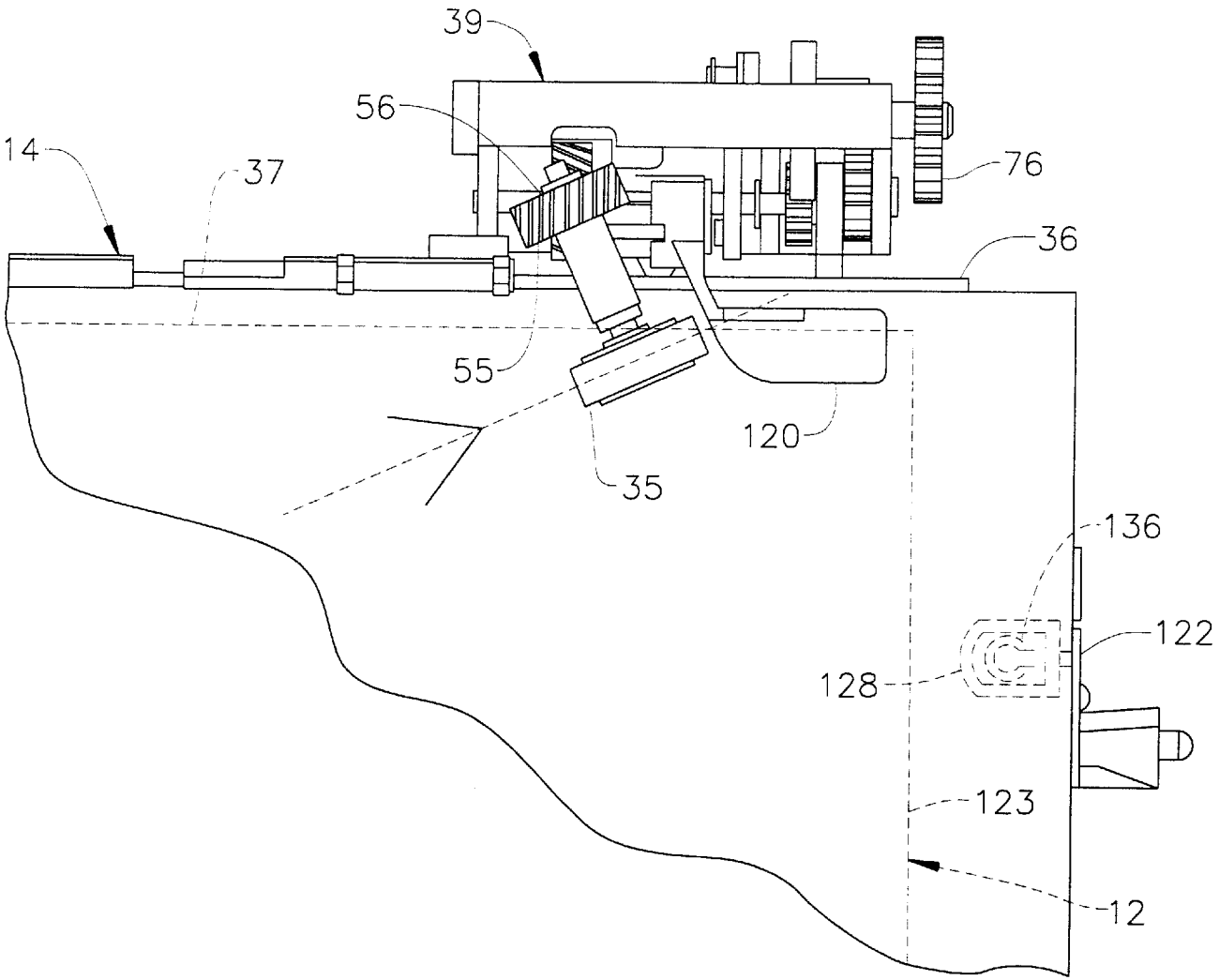
FIG. 11 is a fragmentary top plan view of the sheet aligning assembly of FIG. 7 along with a printed sheet in its initial position in dash lines and in its aligned position after completion of sheet advancement by the aligning roller in solid lines.

The sum of the angles of the teeth of the helical gear 55 and the helical gear 65 is equal to the angle of the aligning roller 35 relative to the side reference barrier 122 (see FIG. 11). The spacing between the side reference barrier 122 and the adjacent side edge 123 of the printed sheet 12 is typically 25 mm. and a maximum of 33 mm. for 8½×11 paper and typically 33 mm. and a maximum of 39 mm. for A4 paper.

With each of the helical gear 55 (see FIG. 7) and the helical gear 65 having their teeth at an angle of 33°, the sum of the angles is 66°. This also is the angle of the aligning roller 35 to the side reference barrier 122 (see FIG. 11) so that the angle of the aligning roller 35 (see FIG. 2) to the rear wall 36 of the accumulator table 14 is 24°.

While the angle of 66° is preferred, it should be understood that an angle in the range of 60° and 70° between the aligning roller 35 (see FIG. 11) and the side reference barrier 122 is satisfactory and other angles also could be employed, if desired. Furthermore, it should be understood that any angle greater than 45° of the aligning roller 35 with respect to the side reference barrier 122 will cause a greater force to be exerted on each of the printed sheets 12 to move it more towards the side reference barrier 122 than towards the rear wall 36.

Figure 5:
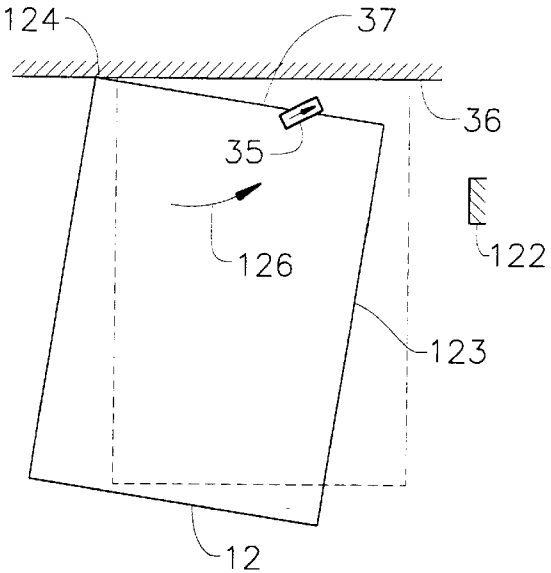
FIG. 5 is a schematic top plan view, similar to FIG. 4, showing advancement of the sheet from the final position of FIG. 4 (solid lines in FIG. 5) and engagement of a rear edge of the sheet with a rear reference barrier in dash lines.
Figure 4:
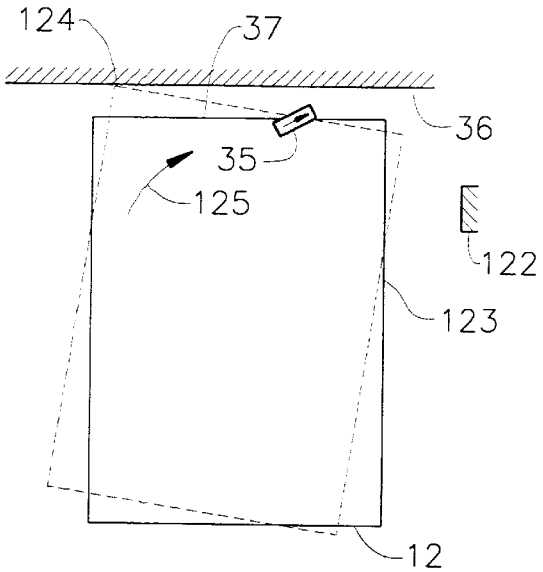
FIG. 4 is a schematic top plan view showing a sheet partially supported on the accumulator table after being fed thereto from exit corrugation rollers in solid lines and a dash line position to which the sheet is initially moved by the aligning roller.

As shown in FIG. 4, the aligning roller 35 initially rotates the printed sheet 12 clockwise from the solid line position until its corner 124 engages the rear wall 36 as shown in dash lines in FIG. 4 and in solid lines in FIG. 5. The clockwise rotation is indicated by an arrow 125.

The aligning roller 35 next advances the printed sheet 12 from the solid line position of FIG. 5 to the dash line position. This includes both counterclockwise rotation (as indicated by an arrow 126) and sliding motion of the printed sheet 12. At this time, the rear edge 37 of the printed sheet 12 has its entire surface engaging the rear wall 36.

Figure 6:
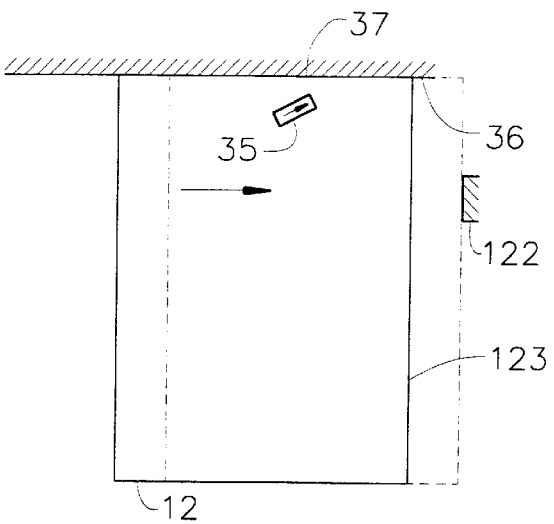
FIG. 6 is a schematic top plan view, similar to FIGS. 4 and 5, in which the solid line position is the position to which the sheet was advanced in FIG. 5 and the dash line position is at completion of advancement of the sheet with a side edge engaging a side reference barrier.

Then, the aligning roller 35 advances the printed sheet 12 from the solid line position of FIG. 6, which is the same as the dash line position of FIG. 5, until the side edge 123 of the printed sheet 12 engages the side reference barrier 122 as shown in dash lines in FIG. 6. At this time, the aligning roller 35 is removed from frictional contact with the printed sheet 12 by the pivotal motion of the housing 46 (see FIG. 7). During motion of the printed sheet 12 (see FIG. 6) only towards the side reference barrier 122, the rear edge 37 of the printed sheet 12 slides along the rear wall 36 with which it is in engagement so as to be in alignment therewith.

In FIG. 6, the side edge 123 of the printed sheet 12 is in engagement with the side reference barrier 122 so as to be in alignment therewith. As used in the claims, the term "alignment" of the rear edge 37 with the rear wall 36 or the side edge 123 of the printed sheet 12 with the side reference barrier 122 means that they are in engagement.

As the side edge 123 of the printed sheet 12 approaches the side reference barrier 122, it engages an angled side surface 127 (see FIG. 17) of a lower portion 128 of a pivotally mounted clamp arm 129. The clamp arm 129 is pivotally mounted on a pin 130 (see FIG. 16), which is fixed to a plate 141. A lever 131 also is pivotally mounted on the plate 141 of the gear box 41.

Figure 17:
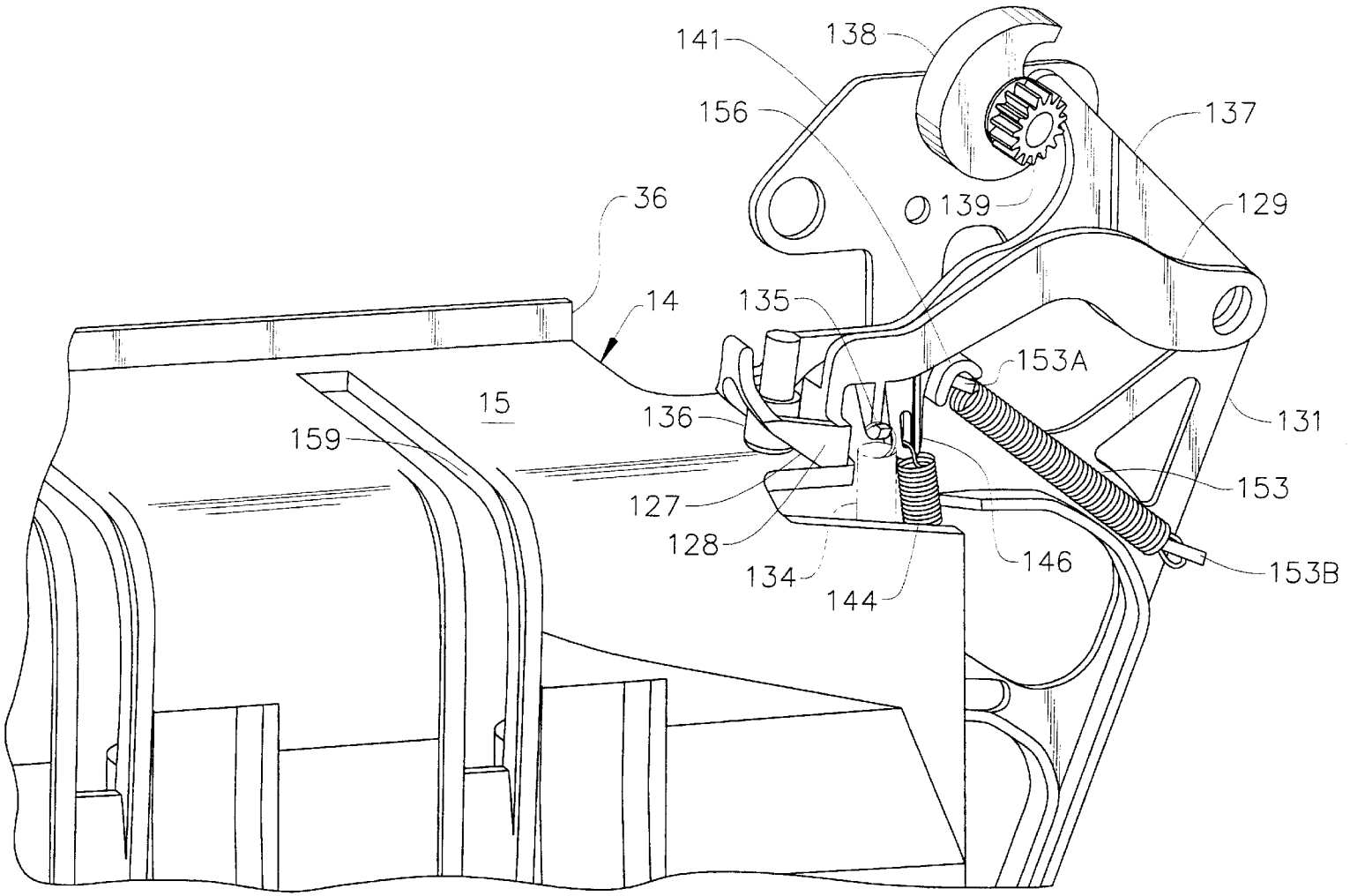
FIG. 17 is a perspective view of a clamp arm having a lower portion for receiving each sheet as it is advanced by the aligning roller towards the side reference barrier and a cam follower arm having a clamp for clamping each printed sheet after it is advanced against the side reference barrier.
Figure 18:
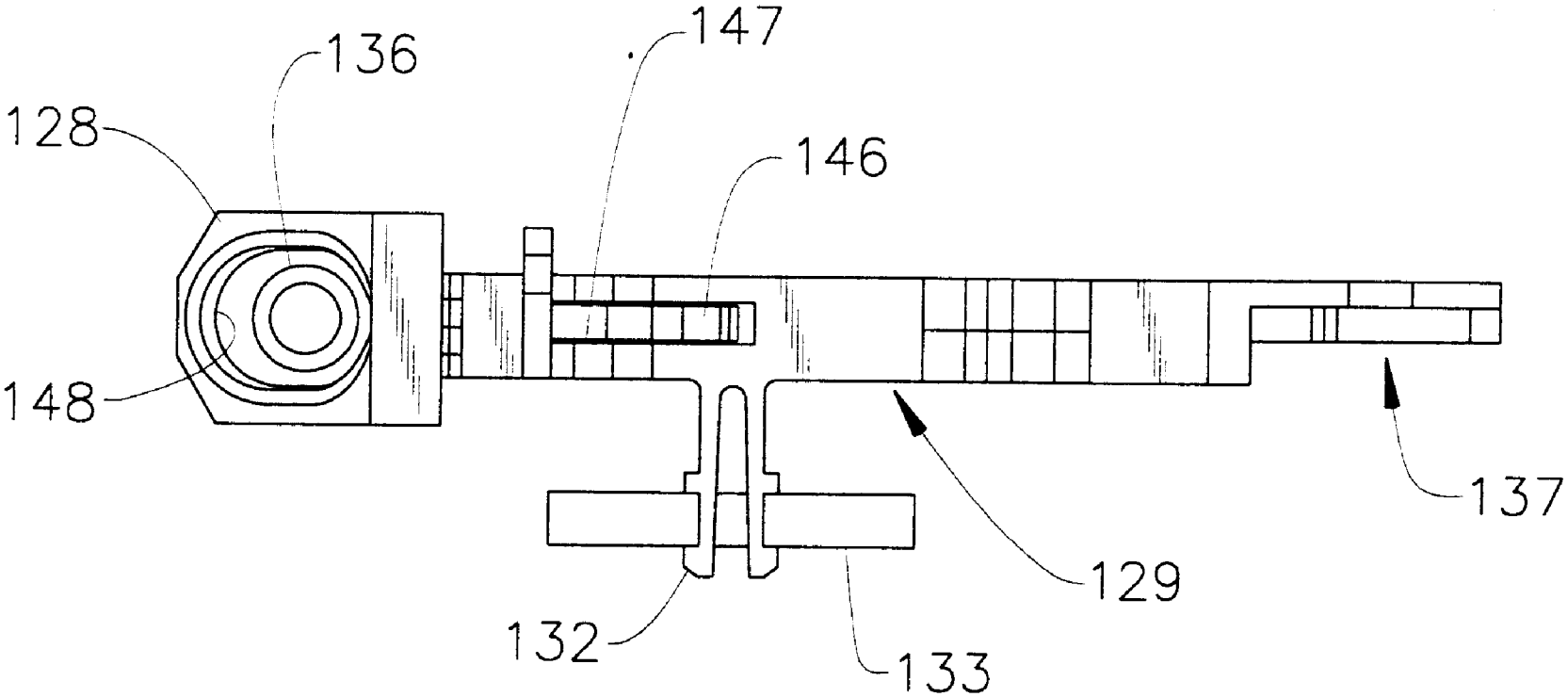
FIG. 18 is a bottom plan view of the clamp arm and the cam follower arm of FIG. 17.

As shown in FIG. 18, the clamp arm 129 has a support 132 extending from one side thereof and on which a counterweight 133 is retained by a snap fit. The force exerted by the counterweight 133 on the clamp arm 129 continuously urges the lower portion 128 (see FIG. 17) downwardly with a predetermined force. When the side edge 123 (see FIG. 1) of the printed sheet 12 approaches the side reference barrier 122, it engages the angled side surface 127 (see FIG. 17) of the lower portion 128 of the pivotally mounted clamp arm 129 before it reaches the side reference barrier 122 (see FIG. 11). The location of the lower portion 128 is shown in phantom in FIG. 11 relative to the rear wall 36 and the side reference barrier 122.

The counterweight 133 (see FIG. 18) provides a force of about seven grams. This force is sufficient to resist curl forces in each of the printed sheets 12 (see FIG. 11) as it moves under the lower portion 128 (see FIG. 17) of the pivotally mounted clamp arm 129.

While the counterweight 133 (see FIG. 18) is the preferred exerting force, it should be understood that the exerting force could be provided by other suitable means such as a spring 134 (shown in phantom in FIG. 17) extending between a spring anchor 135 on the clamp arm 129 and a spring retaining portion (not shown) on the lever 131.

As the side edge 123 (see FIG. 1) of the printed sheet 12 engages the side reference barrier 122, a clamp 136 (see FIG. 17 and shown in phantom in FIG. 1) on an end of a cam follower arm 137 is moved into engagement with the printed sheet 12 (see FIG. 11) to positively clamp the printed sheet 12 against the support surface 15 (see FIG. 17) of the accumulator table 14. The cam follower arm 137 also is pivotally mounted on the pivot pin 130 (see FIG. 16).

The pivotal movement of the cam follower arm 137 (see FIG. 17) is controlled by a cam 138 to remove the clamp 136 during alignment of each of the printed sheets 12 (see FIG. 11). A gear 139 (see FIG. 17) is integral with the cam 138. A stud 140 (see FIG. 16) rotatably supports the cam 138 and the gear 139. The stud 140 is supported on the plate 141 of the gear box 41.

The gear 139 is driven by the motor 80 through the gear train. The gear train includes a pair of bevel gears 142 and 143 to change the axis of rotation of the gear 139 90° from the axes of rotation of the gears of the portion of the gear train driving the gear 76. Thus, one revolution of the cam 138 occurs during each cycle of operation when the gear 76 is driven one revolution.

The cam follower arm 137 is continuously urged against the cam 138 by a spring 144 (see FIG. 17). The spring 144 is attached to the lever 131 and to an extension 146 of the cam follower arm 137.

As shown in FIG. 18, the extension 146 of the cam follower arm 137 extends through a slot 147 in the clamp arm 129. The spring 144 (see FIG. 17) maintains the cam follower arm 137 in contact with the cam 138. This insures that the clamp 136, which extends through a hole 148 (see FIG. 18) in the clamp arm 129, contacts the printed sheet 12 (see FIG. 11) only after the side edge 123 of the printed sheet 12 has engaged the side reference barrier 122. This clamping arrangement insures that the printed sheets 12 remain in their aligned relationship to which they have been moved.

The clamp 136 (see FIG. 17) remains in its sheet engaging position until the edge 123 (see FIG. 6) of the next of the sheets 12 approaches the reference barrier 122. When this occurs, the cam 138 (see FIG. 17) lifts the cam follower arm 137 to lift the clamp 136 so that the edge 123 (see FIG. 6) can move against the reference barrier 122. After the edge 123 of the sheet 12 has engaged the reference barrier 122, the cam 138 (see FIG. 17) drops the cam follower arm 137 to return the clamp 136 into contact with the printed sheet 12 (see FIG. 6) to clamp it and all of the sheets therebeneath.

Figure 19:
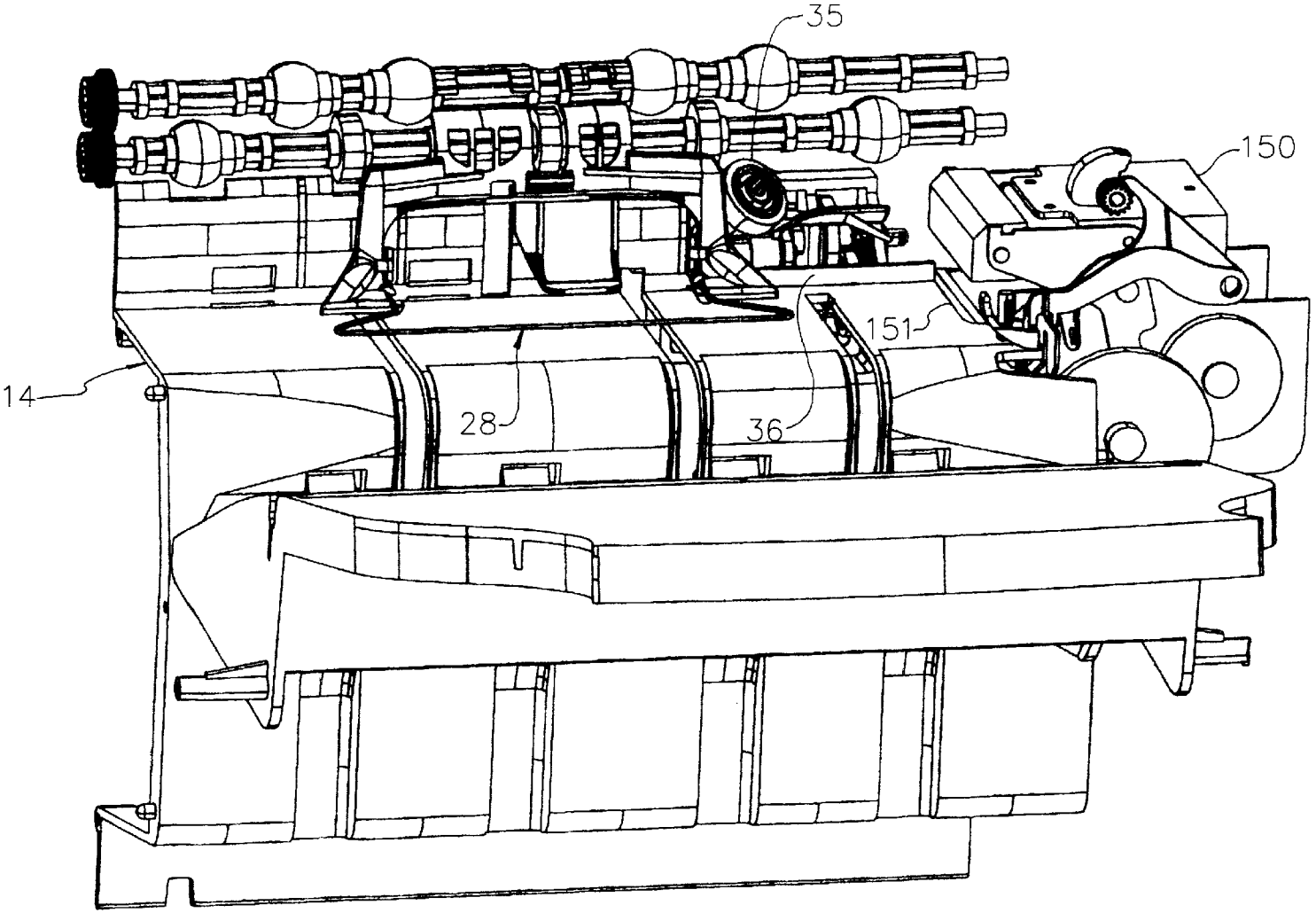
FIG. 19 is a front perspective view of the finisher and showing an electric stapler for stapling aligned stacked sheets.

This cycle continues until the number of the printed sheets 12 to be stapled together is accumulated. Then, an electric stapler 150 (see FIG. 19) is energized.

Figure 28:
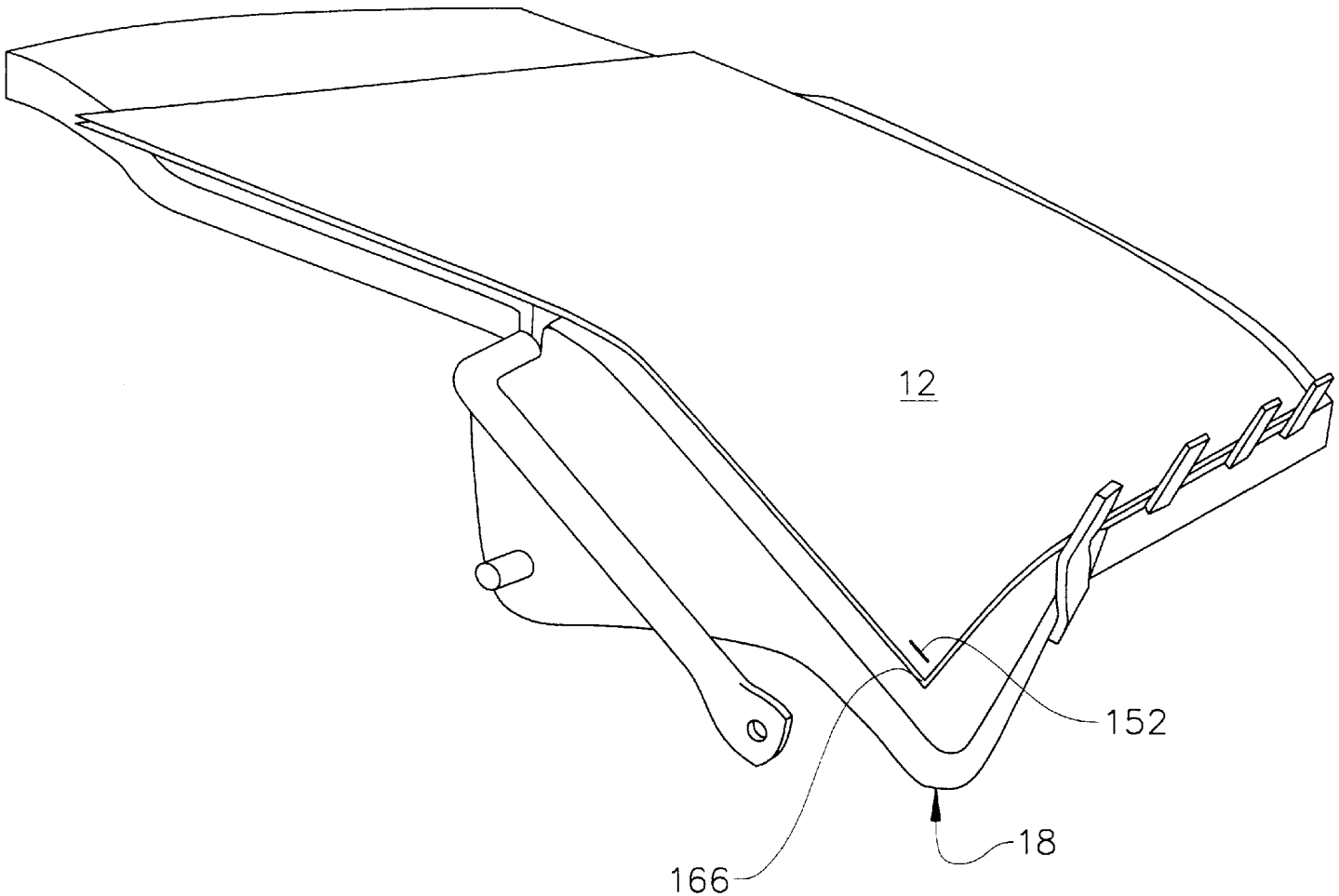
FIG. 28 is a perspective view of an inclined output tray having a single group of stapled sheets supported thereby with a recess or depression in the right rear corner of the inclined output tray for receiving the corner of the single group of stapled sheets having the staple.

The stapler 150 has a throat 151 through which a staple 152 (see FIG. 28) is pushed upwardly to staple the number of sheets selected in accordance with a microprocessor (not shown) in the finisher 11 (see FIG. 1). The printed sheets 12 (see FIG. 28) face downwardly so it is necessary for the staples 152 to be pushed upwardly through the throat 151 (see FIG. 19) to staple the aligned printed sheets 12 (see FIG. 11) to each other to form each group of the stapled printed sheets 12. It should be understood that the staple 152 (see FIG. 19) is in the upper left corner of each of the stapled sheets 12.

One suitable example of the electric stapler 150 (see FIG. 19) is sold by Max Co., Ltd., Tokyo, Japan as Model No. EH-320. Any other suitable electric stapler may be employed, if desired.

Figure 20:
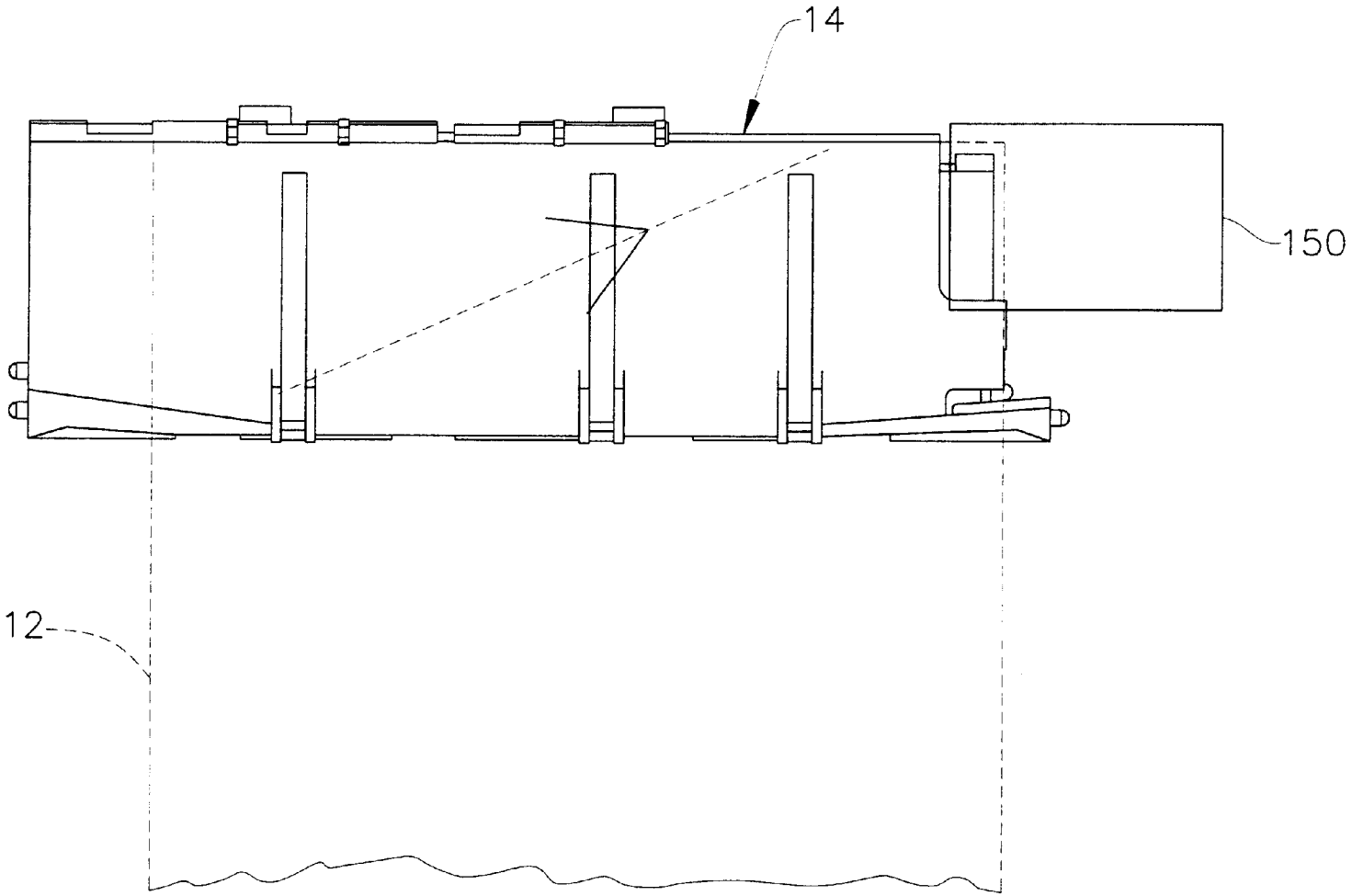
FIG. 20 is a top plan view of a portion of the accumulator table and showing the location of the electric stapler relative to each printed sheet at the aligned position.

After each group of the printed sheets 12 (see FIG. 20) has been stapled together by the stapler 150, the lower portion 128 (see FIG. 17) of the pivotally mounted clamp arm 129 and the clamp 136 on the cam follower arm 137 must be moved out of the path of the printed sheets 12 (see FIG. 1). This allows each group of the printed sheets 12 to be removed from any support by the upper support surface 15 (see FIG. 2) of the accumulator table 14 and advanced to the rearwardly inclined output tray 18 for complete support thereby. This occurs before the start of the next cycle of operation.

A spring 153 (see FIG. 17), which is attached to a hook 153A on the plate 141 and a hook 153B on the lever 131, continuously biases the lever 131 towards the clamp arm 129. A rod 155 (see FIG. 16) has its right end contacting a longitudinal arcuate surface (not shown) of the pivotally mounted lever 131. When the rod 155 is in the position of FIG. 16, the rod 155 overcomes the force of the spring 153 to prevent the spring 153 from causing the lever 131 to pivot clockwise about the pivot pin 130.

The lever 131 has a lifter 156 (see FIG. 17) connected thereto for engaging the clamp arm 129 and the cam follower arm 137 to cause each to pivot clockwise about the pivot pin 130 (see FIG. 16) when the rod 155 drops off an interior cam surface (not shown) of a cam 154. This clockwise pivoting of the clamp arm 129 and the cam follower arm 137 results in the lower portion 128 (see FIG. 17) of the pivotally mounted clamp arm 129 and the clamp 136 on the cam follower arm 137 being raised upwardly away from and out of the path of the printed sheets 12 (see FIG. 11).

The rod 155 (see FIG. 16) is moved to the left by the gear train in the gear box 41 rotating a gear 155', which is integral with the cam 154, to change the portion of the interior cam surface of the cam 154 engaging the rod 155 when the lever 131 is to pivot clockwise from the position of FIG. 17 to move the pivotally mounted clamp arm 129 and the clamp 136 on the cam follower arm 137 upwardly out of the path of the printed sheets 12 (see FIG. 11).

When the lower portion 128 (see FIG. 17) of the clamp arm 129 and the clamp 136 on the cam follower arm 137 are to be reset so as to again engage the next printed sheet 12 (see FIG. 1) as it is aligned, the gear train in the gear box 41 (see FIG. 16) farther rotates the gear 155' to change the portion of the interior cam surface (not shown) of the cam 154 engaging the rod 155. This returns the rod 155 to the position in FIG. 16 in which it contacts the pivotally mounted lever 131 to hold it against the force of the spring 153.

The gear train in the gear box 41 also drives endless belts or bands 157 having pusher tabs 158 thereon. The pusher tabs 158 are utilized to push each group of the stapled printed sheets 12 (see FIG. 28) to the inclined output tray 18 after stapling and before the next cycle of operation. The belts or bands 157 ride in grooves 159 (see FIG. 17) in the support surface 15 of the accumulator table 14 and in the front portion of the accumulator table 14.

It should be understood that the belts or bands 157 (see FIG. 16) and the pivotally mounted lever 131 are only activated after a stapling operation is completed to move each group of the stapled printed sheets 12 (see FIG. 28) to the inclined output tray 18. If stapling is not occurring and each of the printed sheets 12 is not advanced for alignment, then the belts or bands 157 (see FIG. 16) and the pivotally mounted lever 131 are activated after each of the sheets 12 (see FIG. 2) is ejected onto the accumulator table 14. This activation of the belts or bands 157 (see FIG. 16) and the pivotally mounted lever 131 is controlled by the microprocessor (not shown) in the finisher 11 (see FIG. 1).

The inclined output tray 18 (see FIG. 2) has its sheet support surface 165 formed with a cutout recess or depression 166 in its right rear (as viewed from the front) corner. A wall 167 (see FIG. 1) of the finisher 11 constitutes a wall of the recess or depression 166 (see FIG. 2) of the inclined output tray 18.

Accordingly, after the stapled printed sheets 12 are stapled by the electric stapler 150 (see FIG. 20), each group of the stapled printed sheets 12 is advanced along the sheet support surface 165 (see FIG. 2) of the inclined output tray 18. This advancement positions the stapled portion of each group of the stapled printed sheets 12 with its staple 152 (see FIG. 28) disposed above the recess or depression 166 so that the portion of the printed sheet 12 having the staple falls therein until the recess or depression 166 is filled as shown in FIG. 30.

Figure 29:
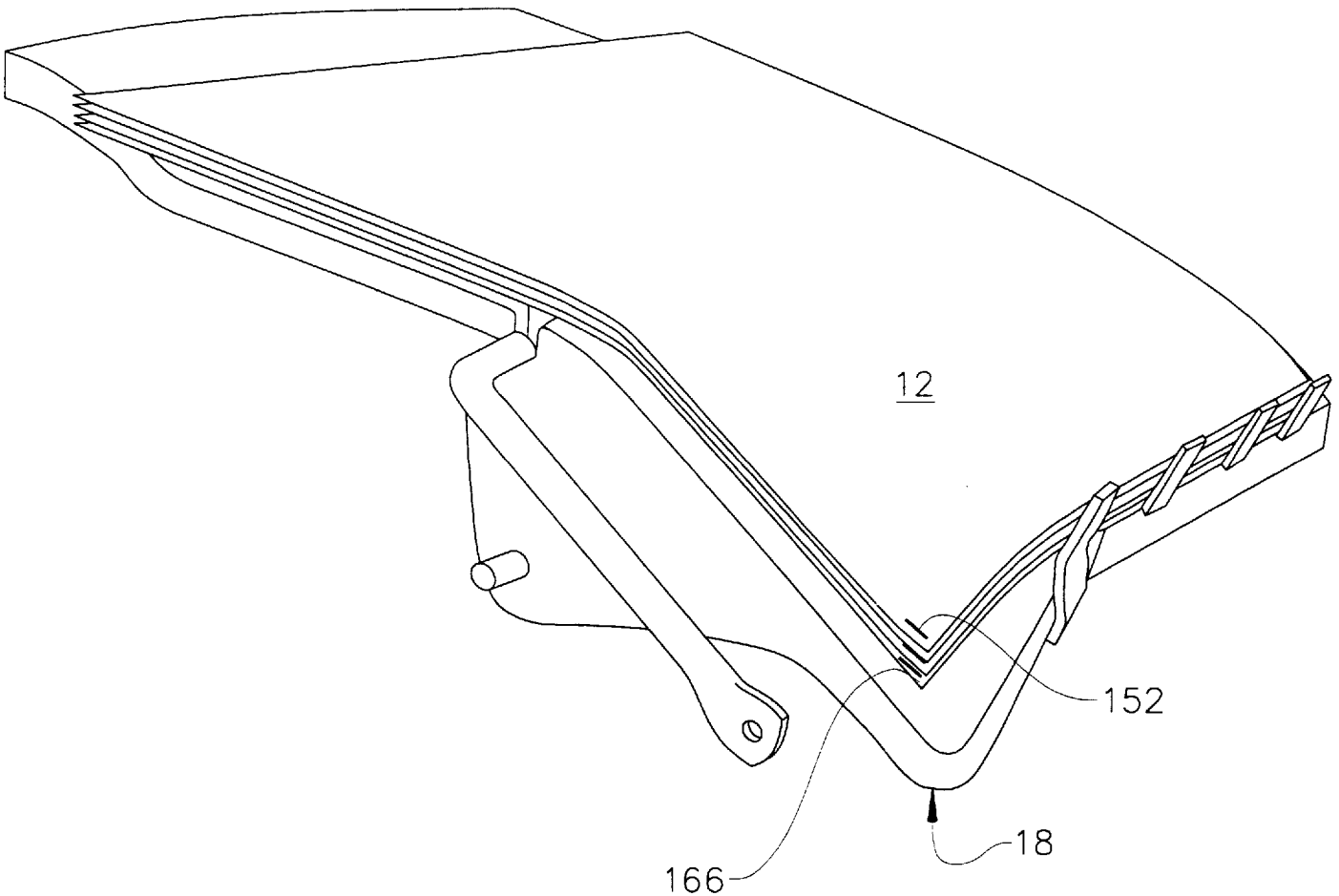
FIG. 29 is a perspective view of the inclined output tray of FIG. 28 with a plurality of groups of stapled sheets supported thereby.
Figure 30:
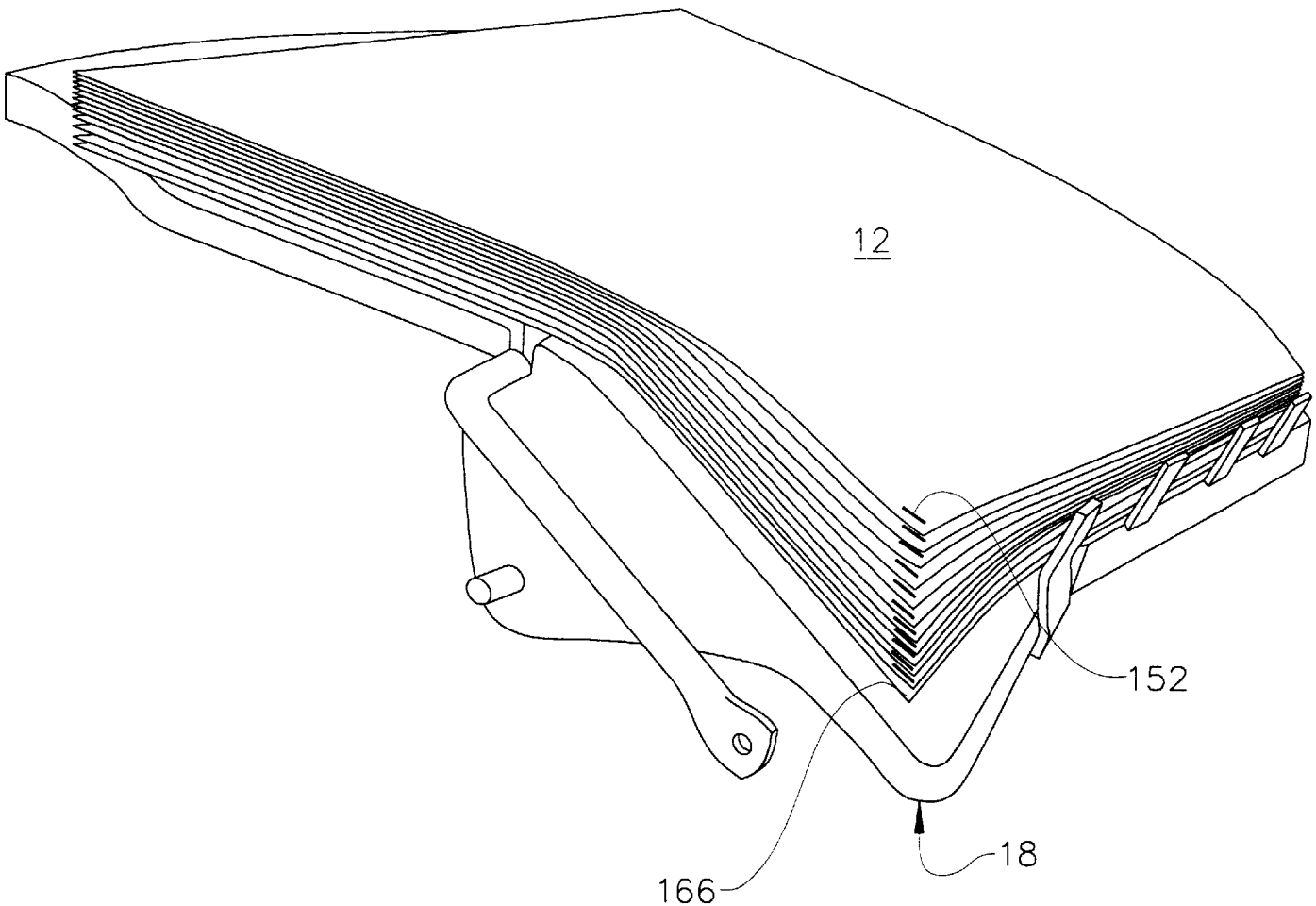
FIG. 30 is a perspective view of the inclined output tray of FIGS. 28 and 29 with the inclined output tray fall of groups of stapled sheets supported thereby.

As the number of the groups of the stapled printed sheets 12 increases as shown in FIGS. 29 and 30, a larger number of the groups of the stapled printed sheets 12 can be disposed on the sheet support surface 165 of the inclined output tray 18 than in the prior inclined output tray, which did not have the recess or depression 166. The recess or depression 166 prevents the staples 152 from increasing the overall height of the right rear corner of the groups of the stapled printed sheets 12 as quickly to limit the capacity of the inclined output tray 18.

Thus, as shown in FIG. 30, it takes a relatively large number of the groups of the stapled sheets 12 before the stack in the right rear corner rises higher than the left rear corner. That is, the right rear corner becomes higher than the left rear corner only when the relatively large number of the groups of the stapled printed sheets 12 are stacked as shown in FIG. 30; this is when the inclined output tray 18 is full as indicated by a sensor (not shown).

It should be understood that the number of the stapled printed sheets 12 in each group of the stapled printed sheets 12 has a significant effect on how quickly the stapled corners of the stapled printed sheets 12 rise above the recess or depression 166. For example, when there are only two of the printed sheets 12 stapled to each other, the right rear corner of the stack of the printed sheets 12 rises quicker than if each of the groups of the printed sheets 12 had a larger number of the printed sheets 12 stapled to each other. This is because the thickness of the staple 152 is the determining factor in the overall thickness of each stapled group since the thickness of the staple 152 is much greater than the thickness of each of the printed sheets 12. With only two of the printed sheets 12 stapled together, a greater number of the staples 152 is present for the same total number of the printed sheets 12.

Figure 31:
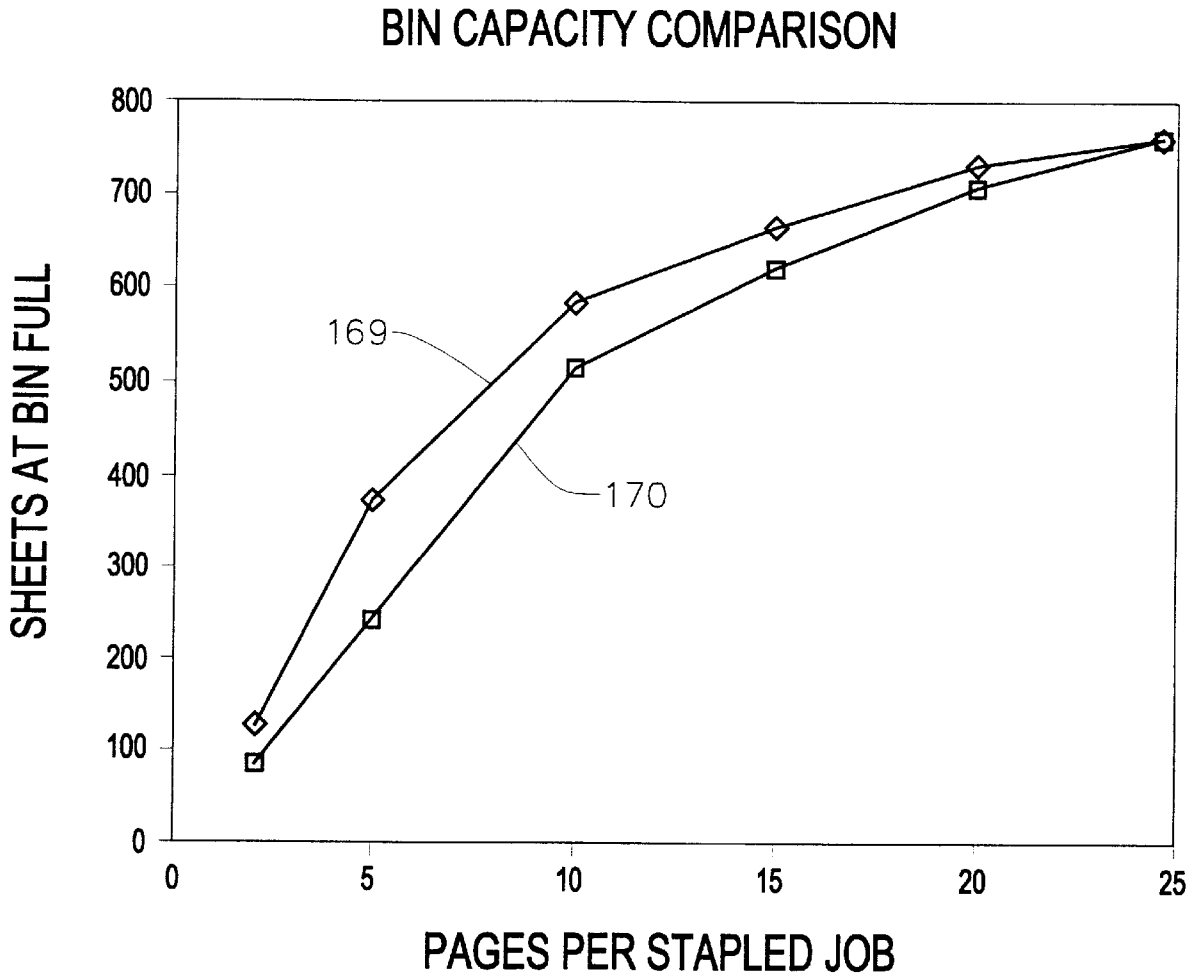
FIG. 31 is a graph comparing the capacity of the inclined output tray of FIG. 28 with its right rear corner having a recess or depression for receiving the stapled corners and the capacity of an inclined output tray with no recess or depression in its right rear corner with different numbers of sheets for each job or group.
Figure 32:
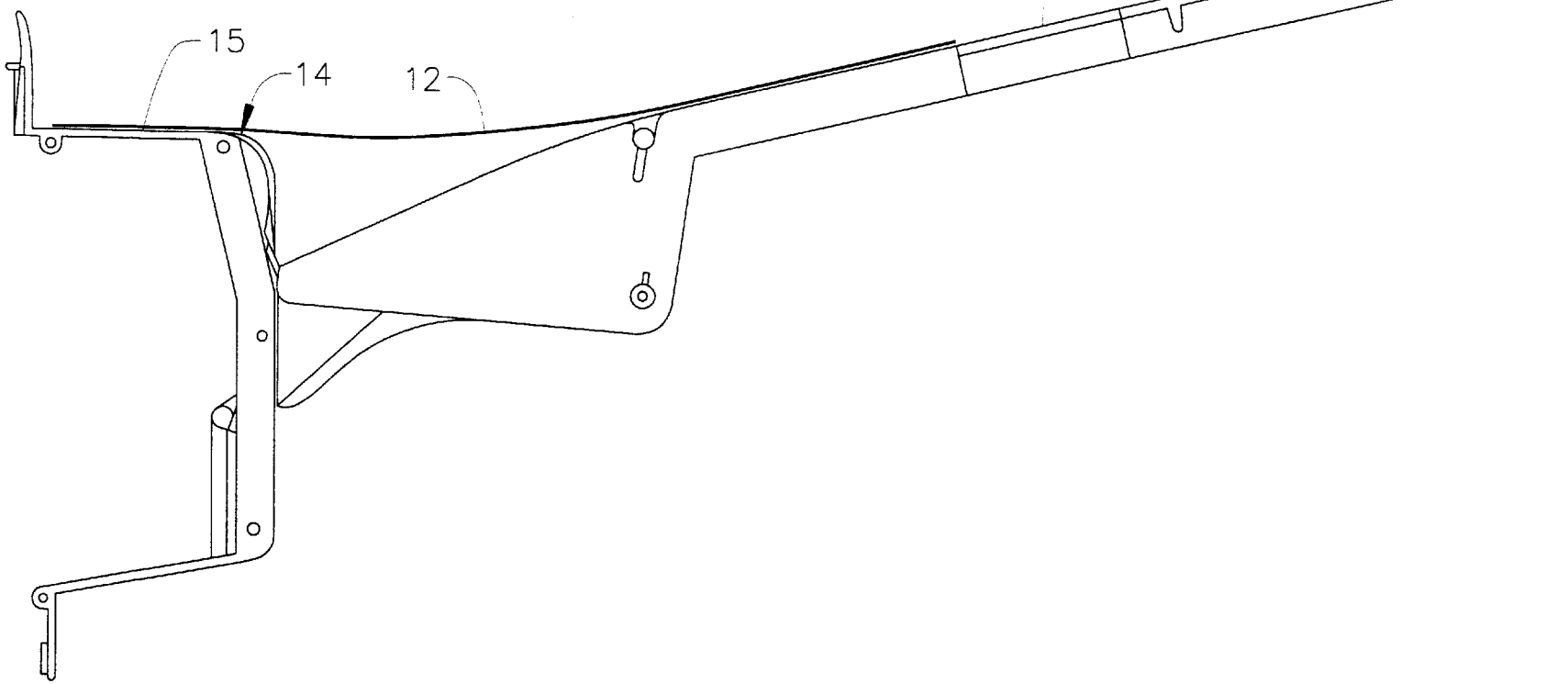
FIG. 32 is a side elevational view of the accumulator table and the inclined output tray with a printed sheet disposed thereon with its upwardly facing arch extending laterally.

The relation of the capacity of the inclined output tray 18 having the recess or depression 166 and the capacity of the inclined output tray 18 without the recess or depression 166 is shown by graph lines 169 and 170, respectively, in FIG. 31. This was based on the following results from comparison tests:

| Sheets/Job | Tray 18 with recess 160 | Tray 18 without recess 160 | Capacity increase (%) |
|---|---|---|---|
| 2 | 126 | 84 | 50.0 |
| 5 | 370 | 240 | 54.2 |
| 10 | 580 | 510 | 13.7 |
| 15 | 660 | 615 | 7.3 |

-continued

| Sheets/Job | Tray 18 with recess 160 | Tray 18 without recess 160 | Capacity increase (%) |
|---|---|---|---|
| 20 | 720 | 700 | 2.9 |
| 25 | 750 | 750 | 0.0. |

While the cutout recess or depression 166 (see FIG. 29) has been shown and described as being formed along two adjacent edges at the right rear corner of the support surface 165 of the inclined output tray 18, it should be understood that the recess or depression 166 could be formed along only one edge of the sheet surface 165, if the staple 152 were located at a different position in each of the stapled sheets 12.

While the roller shaft 49 (see FIG. 9) has been shown and described as driven by the helical gears 55 and 65 (see FIG. 7), it should be understood that other gears may be employed. For example, bevel gears may be utilized.

An advantage of this invention is that it provides high quality alignment of sheets to be stapled together. Another advantage of this invention is that it controls the beam strength of a sheet being fed from an exit rollers and falling by gravity onto a support surface.

For purposes of exemplification, a preferred embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A sheet beam breaker for sheets falling by gravity after exiting from sheet path exit rollers to a sheet support surface having at least a laterally extending portion lower than the remainder of the sheet support surface after exiting from sheet path exit rollers including:

pivotally mounted means movable between a home position and an elevated position in response to movement of each sheet as each sheet exits from the sheet path exit rollers, said pivotally mounted means returning to said home position by gravity when each sheet falls by gravity after exiting from the sheet path exit rollers;

and said pivotally mounted means including a wire bail having a horizontal front portion for removing a longitudinal beam in the sheet as both said beam removal means and the sheet fall by gravity and creating a lateral beam in the sheet upon removal of the longitudinal beam from the sheet.

2. The sheet beam breaker according to claim 1 in which said horizontal front portion contacts each sheet as said beam removal means and the contacted sheet simultaneously fall by gravity to break a longitudinal beam existing in any sheet by said sheet contact means exerting a downward force on the sheet.

3. The sheet beam breaker according to claim 2 in which said horizontal front portion extends laterally for a least about five inches, said horizontal front portion contacting the falling sheet as said bail falls by gravity to exert a downward force on the falling sheet.

4. The sheet beam breaker according to claim 3 in which said pivotally mounted means is engaged by a leading edge of each sheet while the sheet exits from the sheet path exit rollers to pivotally move said pivotally mounted means from its home position to an elevated position.

5. The sheet beam breaker according to claim 2 in which said pivotally mounted means is engaged by a leading edge of each sheet while the sheet exits from the sheet path exit rollers to pivotally move said pivotally mounted means from its home position to an elevated position.

6. The sheet beam breaker according to claim 1 in which said pivotally mounted means is engaged by a leading edge of each sheet while the sheet exits from the sheet path exit rollers to pivotally move said pivotally mounted means from its home position to an elevated position.

* * * * *